US008317165B2

(12) United States Patent
Yamasaki et al.

(10) Patent No.: US 8,317,165 B2
(45) Date of Patent: Nov. 27, 2012

(54) NANOBUBBLE-CONTAINING LIQUID PRODUCING APPARATUS AND NANOBUBBLE-CONTAINING LIQUID PRODUCING METHOD

(75) Inventors: Kazuyuki Yamasaki, Osaka (JP); Kazumi Chuhjoh, Osaka (JP); Koji Iwata, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 570 days.

(21) Appl. No.: 12/574,949

(22) Filed: Oct. 7, 2009

(65) Prior Publication Data

US 2010/0089133 A1 Apr. 15, 2010

(30) Foreign Application Priority Data

Oct. 10, 2008 (JP) ..... 2008-264367

(51) Int. Cl.
*B01F 3/04* (2006.01)

(52) U.S. Cl. ..... 261/26; 261/121.1

(58) Field of Classification Search ..... 261/26, 261/27, 72.1, 119.1, 121.1; 73/61.41; 210/220, 210/620

See application file for complete search history.

(56) References Cited

U.S. PATENT DOCUMENTS

| | | | |
|---|---|---|---|
| 3,842,446 | A | 10/1974 | Hunhausen et al. |
| 5,571,516 | A | 11/1996 | Tezuka et al. |
| 7,641,798 | B2 * | 1/2010 | Yamasaki et al. ..... 210/615 |
| 2004/0238975 | A1 | 12/2004 | Sakakibara et al. |
| 2004/0261167 | A1 | 12/2004 | Panopoulos |
| 2006/0054205 | A1 | 3/2006 | Yabe et al. |
| 2006/0284325 | A1 | 12/2006 | Kohama et al. |
| 2007/0062869 | A1 | 3/2007 | Yamasaki et al. |
| 2008/0189847 | A1 | 8/2008 | Yamasaki et al. |
| 2008/0206362 | A1 | 8/2008 | Yamasaki et al. |
| 2008/0264843 | A1 | 10/2008 | Yamasaki et al. |
| 2008/0296229 | A1 | 12/2008 | Yamasaki et al. |
| 2009/0020474 | A1 | 1/2009 | Yamasaki et al. |
| 2009/0051056 | A1 | 2/2009 | Kikuchi et al. |
| 2009/0101573 | A1 | 4/2009 | Yamasaki et al. |
| 2009/0117241 | A1 | 5/2009 | Tsuji |

(Continued)

FOREIGN PATENT DOCUMENTS

CN 101267876 A 9/2008

(Continued)

OTHER PUBLICATIONS

U.S. Office Action mailed Jun. 8, 2011 in U.S. Appl. No. 12/035,457.

(Continued)

*Primary Examiner* — Robert A Hopkins
(74) *Attorney, Agent, or Firm* — Nixon & Vanderhye P.C.

(57) ABSTRACT

A nanobubble-containing liquid producing apparatus includes: a microbubble generating device that prepares a microbubble-containing liquid with use of a liquid introduced into a microbubble generation tank and discharges the microbubble-containing liquid into the microbubble generation tank; a micro-nanobubble generating device that prepares a micro-nanobubble-containing liquid with use of the microbubble-containing liquid introduced into a micro-nanobubble generation tank and discharges the micro-nanobubble-containing liquid into the micro-nanobubble generation tank; and a nanobubble generating device that prepares a nanobubble-containing liquid with use of the micro-nanobubble-containing liquid introduced into a nanobubble generation tank and discharges the nanobubble-containing liquid into the nanobubble generation tank. Therefore, an apparatus for producing a nanobubble-containing liquid with use of general-purpose products can be manufactured at low cost and in a short period of time.

18 Claims, 13 Drawing Sheets

U.S. PATENT DOCUMENTS

| | | | |
|---|---|---|---|
| 2009/0145827 | A1 | 6/2009 | Yamasaki et al. |
| 2009/0321331 | A1 | 12/2009 | Hassan et al. |

FOREIGN PATENT DOCUMENTS

| | | | |
|---|---|---|---|
| JP | 63-230623 | A | 9/1988 |
| JP | 10-155858 | A | 6/1998 |
| JP | 2002-37725 | A | 2/2002 |
| JP | 2002-053470 | A | 2/2002 |
| JP | 2002-068959 | A | 3/2002 |
| JP | 2002-191518 | A | 7/2002 |
| JP | 2003-334548 | | 11/2003 |
| JP | 2004-121962 | A | 4/2004 |
| JP | 2004-321959 | | 11/2004 |
| JP | 2006-181449 | A | 7/2006 |
| JP | 2006-239353 | A | 9/2006 |
| JP | 2006-239584 | | 9/2006 |
| JP | 2006-281194 | A | 10/2006 |
| JP | 2006-320675 | A | 11/2006 |
| JP | 2007-054655 | A | 3/2007 |
| JP | 2007-75785 | A | 3/2007 |
| JP | 2007-83108 | A | 4/2007 |
| JP | 2007-83143 | A | 4/2007 |
| JP | 3131357 | U | 4/2007 |
| JP | 2007-130591 | A | 5/2007 |
| JP | 2007-215824 | A | 8/2007 |
| JP | 2007-319789 | A | 12/2007 |
| JP | 2008-73658 | A | 4/2008 |
| JP | 2008-79895 | A | 4/2008 |
| JP | 2008-142173 | A | 6/2008 |
| JP | 2008-238064 | A | 10/2008 |
| JP | 2008-272638 | A | 11/2008 |
| JP | 2008-296073 | A | 12/2008 |
| JP | 2009-262008 | A | 11/2009 |
| JP | 2010-22927 | A | 2/2010 |
| KR | 2003-002445 | | 3/2003 |
| KR | 2003-0024455 | | 3/2003 |
| KR | 10-2007-0032250 | | 3/2007 |
| KR | 10-2008-0105003 | | 12/2008 |
| TW | 200712007 | A | 4/2007 |
| TW | 200800379 | A | 1/2008 |
| WO | WO 03/027025 | A1 | 4/2003 |

OTHER PUBLICATIONS

Okajima et al, "Application of Micro Bubbles to Medical Treatment and Its Possibilities", Clean Technology, vol. 17, No. 1, 2007, pp. 17-18 (partial English translation).

Ueda et al, "The Effects on Peripheral Circulation of Bathing Using a New $CO_s$ Bath-Water Generator", The Journal of Japanese Society of Balneology, Climatology and Physical Medicine, vol. 58, No. 4, Aug. 1995, pp. 249-256 (partial English translation).

Yorozu et al, "Research for Carbon Dioxide Bathing II. An Increase of Dermal Blood Flow by the $CO_s$ Preparation", The Journal of Japanese Society of Balneology, Climatology and Physical Medicine, vol. 47, No. 3.4, May 1984, pp. 130-136 (partial English translation.

Watanabe et al, "The Effects of Bathing with Inorganic Salts and Carbon Dioxide on Body Temperature, Systemic Circulation, and Food Ingestion and Absorption", The Journal of Japanese Society of Balneology, Climatology and Physical Medicine, vol. 69, No. 3, May 2006, pp. 167-178 (partial English translation).

Yorozu et al, "The Effects of Crude Drug Extracts Bathing", The Journal of Japanese Society of Balneology, Climatology and Physical Medicine, vol. 55, No. 2, Feb. 1992, pp. 105-112 (partial English translation).

* cited by examiner

NANOBUBBLE-CONTAINING LIQUID PRODUCING APPARATUS AND NANOBUBBLE-CONTAINING LIQUID PRODUCING METHOD

This Nonprovisional application claims priority under 35 U.S.C. §119(a) on Patent Application No. 2008-264367 filed in Japan on Oct. 10, 2008, the entire contents of which are hereby incorporated by reference.

TECHNICAL FIELD

The present invention relates to an apparatus and method for producing a nanobubble-containing liquid containing nanobubbles.

BACKGROUND ART

In recent years, it has been being made known that bubbles with small diameters have various effects. Currently, advances are being made in studies on techniques for preparing such bubbles and their effects. Moreover, attempts are being made to degrade various types of organic matter with use of bubbles.

The bubbles can be classified into microbubbles, micro-nanobubbles, and nanobubbles according to their diameters. Specifically, the microbubbles are bubbles generated with diameters of 10 μm to several tens of micrometers. The micro-nanobubbles are bubbles generated with diameters of several hundreds nanometers to 10 μm. The nanobubbles are bubbles generated with diameters of not more than several hundreds nanometers. It should be noted that the microbubbles change partially into micro-nanobubbles through contraction motions after generation. Further, the nanobubbles have such properties that they can stay in a liquid over a long period of time.

For example, there have conventionally been known various methods for using nanobubbles and various apparatuses using nanobubbles (e.g., see Patent Literature 1 [Japanese Patent Application Publication, Tokukai, No. 2004-121962 A (Publication Date: Apr. 22, 2004)]). More specifically, Patent Literature 1 teaches that nanobubbles exhibit surface action and bactericidal action through an increase in surface area, an enhancement in surface activity, generation of a local high-pressure field, or realization of electrostatic polarization. Furthermore, Patent Literature 1 describes a technique for cleansing various objects and a technique for purifying polluted water with use of the surface action and bactericidal action of the nanobubbles. Furthermore, Patent Literature 1 describes a method for refreshing living organisms with use of the nanobubbles. It should be noted that Patent Literature 1 produces the nanobubbles by electrolyzing water and imparting ultrasonic vibrations to the water.

Further, there has conventionally been known a method for preparing nanobubbles from a liquid (e.g., see Patent Literature 2 [Japanese Patent Application Publication, Tokukai, No. 2003-334548 A (Publication Date: Nov. 25, 2003)]). The preparation method includes the steps of: in a liquid, (1) turning part of the liquid into cracked gas; (2) applying ultrasonic waves to the liquid; or (3) turning part of the liquid into cracked gas and applying ultrasonic waves to the liquid. It should be noted that Patent Literature 2 teaches that it is possible to apply electrolysis or photolysis to the step of turning part of the liquid into cracked gas.

Further, there has conventionally been used a waste liquid treatment apparatus using microbubbles of ozone gas (ozone microbubbles) (e.g., see Patent Literature 3 [Japanese Patent Application Publication, Tokukai, No. 2004-321959 A (Publication Date: Nov. 18, 2004)]). The waste liquid treatment apparatus prepares microbubbles of ozone gas by mixing ozone gas prepared by an ozone generating apparatus into a waste liquid with use of a pressure pump. Moreover, the microbubbles react with organic matter contained in the waste liquid, whereby the organic matter contained in the waste liquid is oxidized and degraded.

Furthermore, in recent years, a nanobubble generating apparatus has been being developed which can generate a large amount of nanobubbles (e.g., see Patent Literature 4 [Japanese Patent No. 4118939 (Publication Date: Jul. 16, 2008)]). This nanobubble generating apparatus makes it possible to apply the large amount of nanobubbles to service water treatment, wastewater treatment, and bathtub treatment, and is expanding in application as far as the field of health and the field of medicine.

As mentioned above, the nanobubbles are expected to be useful in various fields. It is advantageous if an apparatus for producing a nanobubble-containing liquid containing nanobubbles can be manufactured at low cost and in a short period of time. Further, there is a demand for further improvement in method for producing a nanobubble-containing liquid.

Under the circumstances, the conventional nanobubble generating apparatus is not sufficient. There is a strong demand for the development of a nanobubble-containing liquid producing apparatus that can be manufactured at lower cost and in a shorter period of time.

SUMMARY OF INVENTION

It is an object of the present invention to provide a nanobubble-containing liquid producing apparatus that can be manufactured at low cost and in a short period of time.

As a result of their diligent study to attain the foregoing object, the inventors obtained the following findings (1) to (4), thus completing the present invention:

(1) that when three or more liquid tanks each having microbubble-containing liquid preparing means installed therein are disposed in series and each microbubble-containing liquid preparing means is run while a liquid is flowing sequentially from one of the tanks to another, a nanobubble-containing liquid is obtained in the last tank;

(2) that a nanobubble-containing liquid containing a large amount of nanobubbles is obtained by adding a surfactant to at least one of the tanks while running each microbubble-containing liquid preparing means;

(3) that a nanobubble-containing liquid containing a large amount of nanobubbles is obtained by adding a mineral salt to at least one of the tanks while running each microbubble-containing liquid preparing means;

(4) that a nanobubble-containing liquid containing a large amount of nanobubbles is obtained by adding a surfactant and a mineral salt into at least one of the tanks simultaneously while running each microbubble-containing liquid preparing means.

In order to attain the foregoing object, a nanobubble-containing liquid producing apparatus according to the present invention includes: first microbubble-containing liquid preparing means that prepares a first fine-bubble-containing liquid with use of a liquid introduced into a first tank; second micro-nanobubble-containing liquid preparing means that prepares a second fine-bubble-containing liquid with use of the first fine-bubble-containing liquid introduced into a second tank; and third nanobubble-containing liquid preparing means that prepares a third fine-bubble-containing liquid with use of the second fine-bubble-containing liquid introduced into a third tank.

A nanobubble-containing liquid producing method according to the present invention includes: a first microbubble-containing liquid preparing step of preparing a first fine-bubble-containing liquid with use of a liquid introduced into a first tank; a second microbubble-containing liquid preparing step of preparing a second fine-bubble-containing liquid with use of the first fine-bubble-containing liquid introduced into a second tank; and a third microbubble-containing liquid preparing step of preparing a third fine-bubble-containing liquid with use of the second fine-bubble-containing liquid introduced into a third tank.

According to the foregoing configuration, the nanobubble-containing liquid producing apparatus according to the present invention is such that by introducing the liquid sequentially from the first to third tanks disposed in series and actuating the first to third microbubble-containing liquid preparing means respectively installed in the first to third tanks, the third fine-bubble-containing liquid can be obtained as a nanobubble-containing liquid in the third tank, which is the last tank.

That is, first, the first microbubble-containing liquid preparing means prepares the first fine-bubble-containing liquid with use of the liquid introduced into the first tank and discharges the first fine-bubble-containing liquid into the first tank. Next, the first fine-bubble-containing liquid containing microbubbles generated in the first tank is introduced into the second tank, and the second micro-nanobubble-containing liquid preparing means prepares the second fine-bubble-containing liquid with use of the first fine-bubble-containing liquid and discharges the second fine-bubble-containing liquid into the second tank. Furthermore, the second fine-bubble-containing liquid containing micro-nanobubbles generated in the second tank is introduced into the third tank, and the third nanobubble-containing liquid preparing means prepares the third fine-bubble-containing liquid with use of the second fine-bubble-containing liquid and discharges the third fine-bubble-containing liquid into the third tank, whereby the third fine-bubble-containing liquid containing nanobubbles is produced in the third tank.

The first microbubble-containing liquid preparing means, the second micro-nanobubble-containing liquid preparing means, and the third nanobubble-containing liquid preparing means can all be realized by commercially available microbubble generating devices, not by nanobubble generating devices complex in structure. Therefore, the cost of manufacturing the apparatus is greatly reduced, and the apparatus can be manufactured in a short period of time.

Further, the nanobubble-containing liquid producing apparatus according to the present invention is preferably configured such that: the first microbubble-containing liquid preparing means further includes a first shearing section that prepares the first fine-bubble-containing liquid by mixing and shearing the liquid and first supplied gas; the second micro-nanobubble-containing liquid preparing means further includes a second shearing section that prepares the second fine-bubble-containing liquid by further shearing the first fine-bubble-containing liquid; and the third nanobubble-containing liquid preparing means further includes a third shearing section that prepares the third fine-bubble-containing liquid by further shearing the second fine-bubble-containing liquid.

According to the foregoing configuration, the first shearing section prepares the first fine-bubble-containing liquid by mixing and shearing the liquid and first supplied gas; the second shearing section prepares the second fine-bubble-containing liquid by further shearing the first fine-bubble-containing liquid; and the third shearing section prepares the third fine-bubble-containing liquid by further shearing the second fine-bubble-containing liquid. That is, the nanobubble-containing liquid containing nanobubbles can be efficiently prepared by ratcheting down the size of bubbles in the liquid by the plurality of simply structured shearing sections.

Further, the nanobubble-containing liquid producing apparatus according to the present invention is preferably configured such that the first microbubble-containing liquid preparing means further includes first gas supply means that supplies the first supplied gas to the first shearing section. According to the foregoing configuration, the microbubble-containing liquid can be efficiently prepared as a result of the efficient preparation of the first fine-bubble-containing liquid by the first shearing section.

Further, the nanobubble-containing liquid producing apparatus according to the present invention is preferably configured such that: the second micro-nanobubble-containing liquid preparing means further includes second gas supply means through which second supplied gas is supplied to the second shearing section, and the second shearing section prepares the second fine-bubble-containing liquid by mixing and shearing the second supplied gas and the first fine-bubble-containing liquid; and the third nanobubble-containing liquid preparing means further includes third gas supply means through which third supplied gas is supplied to the third shearing section, and the third shearing section prepares the third fine-bubble-containing liquid by mixing and shearing the third supplied gas and the second fine-bubble-containing liquid.

According to the foregoing configuration, the second shearing section further mixes the second supplied gas into the first fine-bubble-containing liquid prepared by the first shearing section and shears the mixture, thereby preparing the second fine-bubble-containing liquid containing a larger amount of micro-nanobubbles. Then, the third shearing section further mixes the third supplied gas into the second fine-bubble-containing liquid and shears the mixture, thereby preparing the third fine-bubble-containing liquid containing a larger amount of nanobubbles. Therefore, a nanobubble-containing liquid containing a larger amount of nanobubbles can be efficiently and reasonably prepared.

Further, the nanobubble-containing liquid producing apparatus according to the present invention is preferably configured such that the preparation of the first fine-bubble-containing liquid by the first shearing section, the preparation of the second fine-bubble-containing liquid by the first shearing section, and the preparation of the third fine-bubble-containing liquid by the third shearing section are each carried out by a cavitation system, a pressure-solution system, a turbulent-shear system, a high-speed rotation stirring system, or a swirling-flow system according to the properties of the water being treated.

The foregoing configuration makes it possible to easily prepare nanobubbles with use of the first microbubble-containing liquid preparing means, the second micro-nanobubble-containing liquid preparing means, and the third nanobubble-containing liquid preparing means. That is, the microbubble-containing liquid preparing means is commercially available as a cavitation system, a pressure-solution system, a turbulent-shear system, a high-speed-rotation-stirring system, or a swirling-flow system, and they are rich in versatility. Therefore, the nanobubble-containing liquid producing apparatus according to the present invention can be easily manufactured by employing any one of such microbubble-containing liquid preparing means as microbubble-containing liquid preparing means to be installed in the first to third tanks.

Further, the nanobubble-containing liquid producing apparatus according to the present invention is preferably configured to further include: a water storage tank into which the liquid is introduced; and first transfer means that transfers the liquid stored in the water storage tank into the first tank.

Since the foregoing configuration includes the water storage tank into which the liquid is introduced and the first transfer means that transfers the liquid stored in the water storage tank into the first tank, the foregoing configuration makes it possible that the nanobubble-containing liquid is efficiently prepared from the liquid stored in the water storage tank by introducing the liquid stored in the water storage tank into the first tank and further introducing the liquid sequentially into the second and third tanks.

Further, the nanobubble-containing liquid producing apparatus according to the present invention is preferably configured such that the liquid is wastewater, clean water, sewage, recycled water, crude oil, fuel oil, a useful-material-containing liquid, groundwater, air-conditioning water, or scrubber water.

That is, when the liquid that is used for preparing the nanobubble-containing liquid is wastewater, the efficiency of wastewater treatment can be enhanced by blowing nanobubbles into the wastewater. Alternatively, when the liquid is clean water, the efficiency of purification of water can be enhanced by blowing nanobubbles into the clean water. Alternatively, when the liquid is recycled water, the efficiency of treatment of the recycled water can be enhanced by blowing nanobubbles into the recycled water. Alternatively, when the liquid is crude oil or fuel oil, the efficiency of refinement of the crude oil can be improved, or the fuel efficiency and quality of the fuel oil can be improved. Alternatively, when the liquid is a useful-material-containing liquid, the various effects of the useful-material-containing liquid can be enhanced by blowing nanobubbles into the useful-material-containing liquid. Alternatively, when the liquid is groundwater, a small amount of a persistent substance contained in the groundwater can be oxidized and degraded by nanobubbles. Alternatively, when the liquid is air-conditioning water, generation of slime and scale in an air-conditioning apparatus can be prevented by blowing nanobubbles into the air-conditioning water. Alternatively, when the liquid is scrubber water, it is useful in improving the cleansing effect of a scrubber on gas and preventing generation of algae and slime in a filling material installed in the scrubber.

Further, the nanobubble-containing liquid producing apparatus according to the present invention is preferably configured to further include: a fourth tank into which the third fine-bubble-containing liquid is introduced; and nanobubble content measuring means that measures a nanobubble content of the third fine-bubble-containing liquid stored in the fourth tank.

The foregoing configuration makes it possible to introduce, into the fourth tank, the third fine-bubble-containing liquid discharged into the third generation tank and measure the nanobubble content of the third fine-bubble-containing liquid, thus making it possible to easily prepare a nanobubble-containing liquid containing a desired amount of nanobubbles. That is, the nanobubble content of a nanobubble-containing liquid to be prepared can be easily adjusted.

Further, the nanobubble-containing liquid producing apparatus according to the present invention can also be configured such that the nanobubble content measuring means further includes oxidization-reduction potential detecting means and measures the nanobubble content in accordance with an oxidization-reduction potential of the third fine-bubble-containing liquid as detected by the oxidization-reduction potential detecting means.

According to the foregoing configuration, the nanobubble content of the third fine-bubble-containing liquid obtained in the third tank can be measured in accordance with the value of the oxidization-reduction potential of the third fine-bubble-containing liquid. That is, since the value of an oxidization-reduction potential is correlated with a nanobubble content, the nanobubble content of a nanobubble-containing liquid to be prepared can be adjusted in accordance with the value of the oxidization-reduction potential measured.

Further, the nanobubble-containing liquid producing apparatus according to the present invention can also be configured such that the nanobubble content measuring means includes a zeta potential detecting means and measures the nanobubble content in accordance with a zeta potential of the third fine-bubble-containing liquid as detected by the zeta potential detecting means.

According to the foregoing configuration, the nanobubble content of the third fine-bubble-containing liquid obtained in the third tank can be measured in accordance with the value of the zeta potential of the third fine-bubble-containing liquid. That is, since the value of a zeta potential is correlated with a nanobubble content, the nanobubble content of a nanobubble-containing liquid to be prepared can be adjusted in accordance with the value of the zeta potential measured.

Further, the nanobubble-containing liquid producing apparatus according to the present invention is preferably configured to further include: a surfactant tank having a surfactant stored therein; and surfactant supply means through which the surfactant stored in the surfactant tank is supplied to each of the first to third tanks.

The foregoing configuration makes it possible that a nanobubble-containing liquid containing a larger amount of nanobubbles is prepared by supplying the surfactant stored in the surfactant tank to at least one or more of the first to third tanks. It should be noted here that since the surfactant is a substance that reduces interfacial tension, the amount of bubbles that are contained in the first fine-bubble-containing liquid, the amount of bubbles that are contained in the second fine-bubble-containing liquid, and the amount of bubbles that are contained in the third fine-bubble-containing liquid can be increased by supplying the surfactant to at least one of the first to third tanks, into which the first fine-bubble-containing liquid, the second fine-bubble-containing liquid, and the third fine-bubble-containing liquid are discharged, respectively. As a result, a nanobubble-containing liquid containing a large amount of nanobubbles can be prepared in the third tank, which is the last tank.

Further, the nanobubble-containing liquid producing apparatus according to the present invention is preferably configured to further include: a mineral salt tank having an inorganic salt stored therein; and inorganic salt supply means through which the inorganic salt stored in the mineral salt tank is supplied to each of the first to third tanks.

The foregoing configuration makes it possible that a nanobubble-containing liquid containing a larger amount of nanobubbles is prepared by supplying the inorganic salt stored in the mineral salt tank to at least one or more of the first to third tanks. It should be noted here that since addition of the inorganic salt to a liquid turns the liquid into an electrolyte in which bubbles are easily generated, the amount of bubbles that are contained in the first fine-bubble-containing liquid, the amount of bubbles that are contained in the second fine-bubble-containing liquid, and the amount of bubbles that are contained in the third fine-bubble-containing liquid can be increased by supplying the inorganic salt to at least one of the first to third tanks, into which the first fine-bubble-containing liquid, the second fine-bubble-containing liquid, and the third fine-bubble-containing liquid are discharged, respectively. As a result, a nanobubble-containing liquid containing a large amount of nanobubbles can be prepared in the third tank, which is the last tank.

Further, the nanobubble-containing liquid producing apparatus according to the present invention is preferably configured to further include surfactant metering pumps that regulate amounts of the surfactant that is supplied from the surfactant tank to the first to third tanks, respectively. This makes it possible to easily regulate the amounts of the surfactant that is supplied to the first to third tanks, respectively, thus making it possible to easily regulate the nanobubble content of a nanobubble-containing liquid to be prepared.

Further, the nanobubble-containing liquid producing apparatus according to the present invention is preferably configured to further include control means that controls the surfactant metering pumps in accordance with the nanobubble content measured by the nanobubble content measuring means, so that the amounts of the surfactant that is supplied are regulated.

According to the foregoing configuration, the control means controls the surfactant metering pumps in accordance with the nanobubble content of the third fine-bubble-containing liquid as measured by the nanobubble content measuring means. That is, a nanobubble-containing liquid containing a desired amount of nanobubbles can be easily prepared by adjusting, in accordance with the nanobubble content of the nanobubble-containing liquid prepared, the amounts of the surfactant that is supplied.

Further, the nanobubble-containing liquid producing apparatus according to the present invention is preferably configured to further include inorganic salt metering pumps that regulate amounts of the inorganic salt that is supplied from the mineral salt tank to the first to third tanks, respectively. This makes it possible to easily regulate the amounts of the inorganic salt that is supplied to the first to third tanks, respectively, thus making it possible to easily regulate the nanobubble content of a nanobubble-containing liquid to be prepared.

Further, the nanobubble-containing liquid producing apparatus according to the present invention is preferably configured to further include control means that controls the inorganic salt metering pumps in accordance with the nanobubble content measured by the nanobubble content measuring means, so that the amounts of the inorganic salt that is supplied are regulated.

According to the foregoing configuration, the control means controls the inorganic salt metering pumps in accordance with the nanobubble content of the third fine-bubble-containing liquid as measured by the nanobubble content measuring means. That is, a nanobubble-containing liquid containing a desired amount of nanobubbles can be easily prepared by adjusting, in accordance with the nanobubble content of the nanobubble-containing liquid prepared, the amounts of the inorganic salt that is supplied.

Further, the nanobubble-containing liquid producing apparatus according to the present invention is preferably configured to further include second transfer means that transfers the third fine-bubble-containing liquid stored in the third or fourth tank into a biological apparatus, a chemical apparatus, a physical apparatus, or a bathtub apparatus.

That is, the transfer of the prepared nanobubble-containing liquid into a biological apparatus, a chemical apparatus, a physical apparatus, and a bathtub apparatus makes it possible to effectively use the nanobubble-containing liquid in these apparatuses. Use of the nanobubble-containing liquid in biological apparatuses increases the activity of living organisms associated various biological apparatuses, thus making it possible to enhance biological reactions. For example, use of the nanobubble-containing liquid in a biological apparatus for use in breeding makes it possible to improve the growth rate of fish to be bred. Use of the nanobubble-containing liquid in a biological apparatus for use in tank farming makes it possible to accelerate the growth of plants. Furthermore, use of the nanobubble-containing liquid in wastewater treatment in a biological apparatus activates microorganisms in the wastewater, thus making it possible to improve the quality of treated water or the capacity of treatment while stabilizing the treatment.

Further, use of the prepared nanobubble-containing liquid in chemical apparatuses makes it possible to enhance the reaction efficiency of chemical reactions related to various chemical apparatuses.

Further, use of the prepared nanobubble-containing liquid in physical apparatuses makes it possible to enhance physical action related to various physical apparatuses. For example, use of the nanobubble-containing liquid in a physical apparatus serving as an activated carbon adsorbing apparatus increase the adsorption of activated carbon. Furthermore, the use of the nanobubble-containing liquid in the apparatus causes a phenomenon in which microorganisms having proliferated in the activated carbon degrade organic matter adsorbed by the activated carbon. That is, the activated carbon is automatically recycled by the microorganisms.

Furthermore, in the case of use of the prepared nanobubble-containing liquid in a bathtub apparatus, the effect of hyperthermia of bathwater, the cleansing effect on human skins, and the action of increase in blood flow of human bodies can be expected, whereby the nanobubble-containing liquid can be used for medical purposes.

For a fuller understanding of the nature and advantages of the invention, reference should be made to the ensuing detailed description taken in conjunction with the accompanying drawings.

DESCRIPTION OF EMBODIMENTS

First Embodiment

A first embodiment of a nanobubble-containing liquid producing apparatus according to the present invention is described below with reference to FIG. 1. The embodiment below is an example of a nanobubble-containing liquid producing apparatus according to the present invention, and as such, is not limited to the example.

<Configuration of a Nanobubble-Containing Liquid Producing Apparatus>

Figure 1:
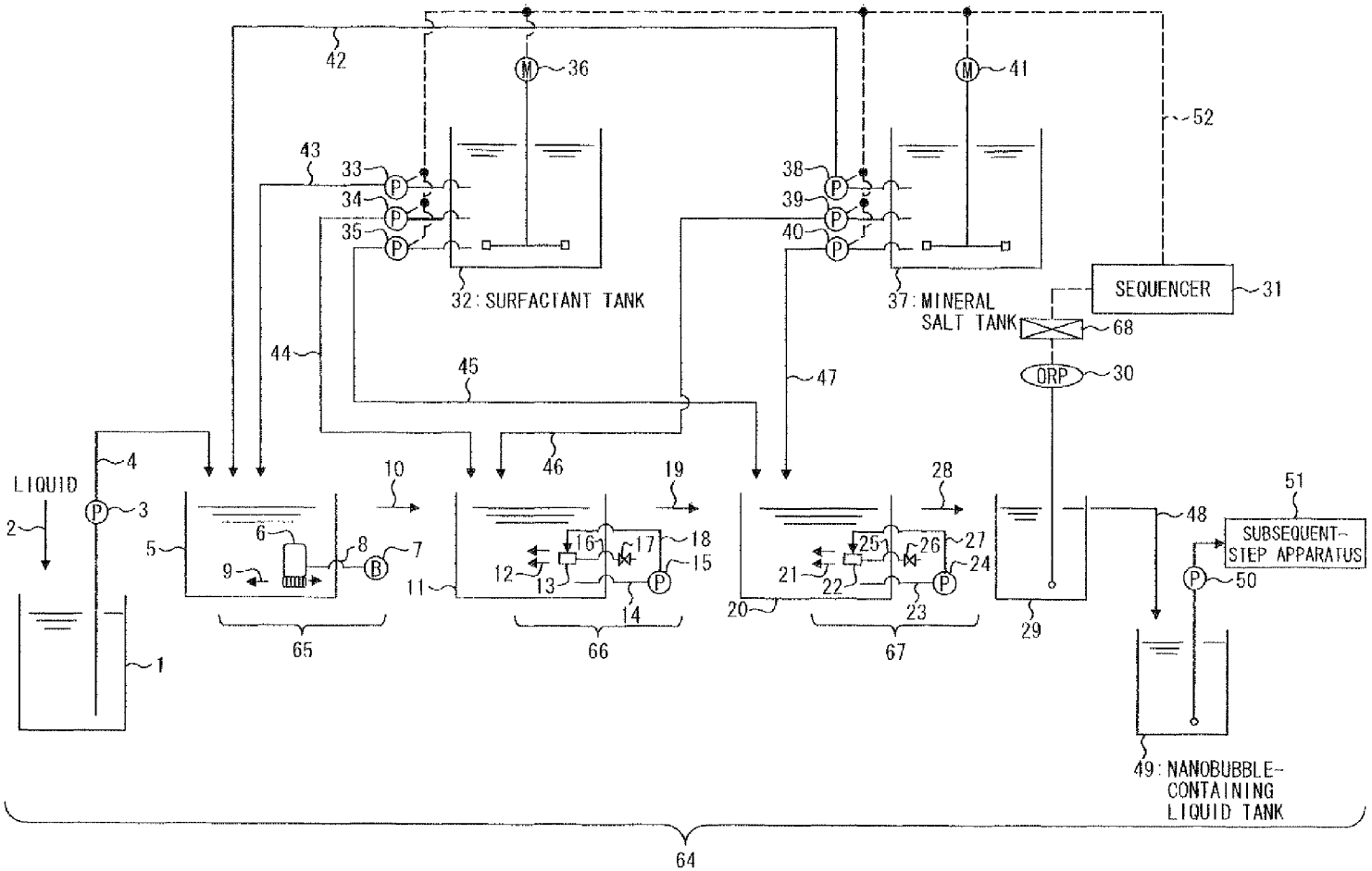
FIG. 1 is a pattern diagram showing a first embodiment of a nanobubble-containing liquid producing apparatus according to the present invention.

FIG. 1 is a pattern diagram schematically showing the configuration of a nanobubble-containing liquid producing apparatus 64 according to the first embodiment. As shown in FIG. 1, the nanobubble-containing liquid producing apparatus 64 according to the present embodiment includes a water storage tank 1, a microbubble generation tank 5 (first tank), a micro-nanobubble generation tank 11 (second tank), a nanobubble generation tank 20 (third tank), a measuring tank (fourth tank) 29, a sequencer (control means) 31, a surfactant tank 32, a mineral salt tank 37, and a nanobubble-containing liquid tank 49.

The water storage tank 1 is a tank into which a liquid in which nanobubbles are to be generated is introduced. Connected to the water storage tank 1 are an inflow pipe 2 through which the liquid is introduced into the water storage tank 1 and a liquid pipe (first transfer means) 4 through which the liquid stored in the water storage tank 1 is transferred into the microbubble generation tank 5 by a first transfer pump (first transfer means) 3.

The water storage tank 1 is not particularly limited in specific configuration, and may be configured, for example, such that the liquid is introduced through the inflow pipe 2 and the liquid is further transferred into the microbubble generation tank 5 through the liquid pipe 4.

The first transfer pump 3 transfers the liquid, which has been introduced into the water storage tank 1, into the microbubble generation tank 5 through the liquid pipe 4. The foregoing configuration makes it possible that a nanobubble-containing liquid is efficiently prepared from the liquid stored in the water storage tank 1 by introducing the liquid stored in the water storage tank 1 into the microbubble generation tank 5 and further transferring the liquid sequentially into the micro-nanobubble generation tank 11 and the nanobubble generation tank 20.

Further, the water storage tank 1 is not particularly limited in liquid that is introduced thereinto; however, it is preferable, for example, that the liquid be wastewater, clean water, sewage, recycled water, crude oil, fuel oil, a useful-material-containing liquid, groundwater, air-conditioning water, or scrubber water.

That is, when the liquid that is used for preparing the nanobubble-containing liquid is wastewater, the efficiency of wastewater treatment can be enhanced by blowing nanobubbles into the wastewater. Alternatively, when the liquid is clean water, the efficiency of purification of water can be enhanced by blowing nanobubbles into the clean water. Alternatively, when the liquid is sewage, the efficiency of treatment of the sewage can be enhanced by blowing nanobubble into the sewage. Alternatively, when the liquid is recycled water, the efficiency of treatment of the recycled water can be enhanced by blowing nanobubbles into the recycled water. Alternatively, when the liquid is crude oil or fuel oil, the efficiency of refinement of the crude oil can be improved, or the fuel efficiency and quality of the fuel oil can be improved. Alternatively, when the liquid is a useful-material-containing liquid, the effect of the useful-material-containing liquid can be enhanced by blowing nanobubbles into the useful-material-containing liquid. Alternatively, when the liquid is groundwater, a small amount of a persistent substance contained in the groundwater can be oxidized and degraded by nanobubbles. Alternatively, when the liquid is air-conditioning water, generation of slime and scale in an air-conditioning apparatus can be prevented by blowing nanobubbles into the air-conditioning water. Alternatively, when the liquid is scrubber water, it is useful in improving the cleansing effect of a scrubber on gas and preventing generation of algae and slime in a filling material installed in the scrubber.

The microbubble generation tank 5 is a tank in which a microbubble-containing liquid (first fine-bubble-containing liquid) is prepared, and includes a microbubble generating device (first microbubble-containing liquid preparing means) 65 and an overflow pipe 10.

The microbubble generation tank 5 is not particularly limited in specific configuration, and may be configured, for example, such that the liquid is transferred from the water storage tank 1 and the microbubble-containing liquid is prepared by the microbubble generating device 65.

The microbubble generating device 65 is a device that prepares the microbubble-containing liquid with use of the liquid introduced into the microbubble generation tank 5 and discharges the microbubble-containing liquid into the microbubble generation tank 5, and includes a microbubble generator 6, a small-sized blower (first gas supply means) 7, and a gas pipe 8.

The microbubble generating device 65 is not particularly limited in specific configuration, but can be realized, for example, by a microbubble generating device ("Micro-Bubbler MB-400"; manufactured by Nomura Electronics Co., Ltd.) including a submerged-pump microbubble generator 6.

Further, the microbubble generating device 65 is not particularly limited in location where it is installed, as long as the microbubble generator 6 can suck in the liquid introduced into the microbubble generation tank 5 and prepare microbubble-containing water. Further, the microbubble generation tank 5 and the microbubble generating device 65 do not need to be formed integrally, and can be constituted by a combination of separate members.

The microbubble generator 6 is not particularly limited; however, it is preferable that the microbubble generator 6 include a submerged pump. The foregoing configuration makes it possible to prepare the microbubble-containing liquid by mixing and shearing the liquid and gas by an impeller section (first shearing section) housed in the submerged pump. As a result, a nanobubble-containing liquid can be efficiently prepared.

The small-sized blower 7 only needs to supply gas to the microbubble generator 6. An example of the gas that is supplied from the small-sized blower 7 is, but is not limited to, air. For example, it is possible to select from among ozone gas, oxygen gas, and nitrogen gas for different purposes. Further, the microbubble generator 6 and the small-sized blower 7 connected via the gas pipe 8, which serves as a path through which the small-sized blower 7 supplies the gas to the microbubble generator 6.

Further, the overflow pipe 10 is connected to the microbubble generation tank 5 and the micro-nanobubble generation tank 11, and the microbubble-containing liquid prepared in the microbubble generation tank 5 is introduced into the micro-nanobubble generation tank 11 by overflow through the overflow pipe 10. The term "overflow" here means that the liquid simply flows into and out of the microbubble generation tank 5. That is, the liquid is transferred from the water storage tank 1 into the microbubble generation tank 5 by the first transfer pump 3, which is run continuously so that the liquid is introduced from the microbubble generation tank 5 into the micro-nanobubble generation tank 11 in such a way as to flow out of the microbubble generation tank 5.

The micro-nanobubble generation tank 11 is a tank in which a micro-nanobubble-containing liquid (second fine-bubble-containing liquid) is prepared, and includes a micro-nanobubble generating device (second micro-nanobubble-containing liquid preparing means) 66 and an overflow pipe 19.

The micro-nanobubble generation tank 11 is not particularly limited in specific configuration, and may be configured, for example, such that the microbubble-containing liquid is introduced from the microbubble generation tank 5 through the overflow pipe and the micro-nanobubble-containing liquid is prepared by the micro-nanobubble generating device 66.

The micro-nanobubble generating device 66 is a device that prepares the micro-nanobubble-containing liquid with use of the microbubble-containing liquid introduced into the micro-nanobubble generation tank 11 and discharges the micro-nanobubble-containing liquid into the micro-nanobubble generation tank 11, and includes a suction pipe 14, a circulating pump 15, a gas pipe 16, a gas needle valve (second gas supply means) 17, a liquid pipe 18, and a micro-nanobubble generator 13.

The micro-nanobubble generating device 66 is not particularly limited in specific configuration, but may include the circulating pump 15, for example, in the form of a high-lift pump. The foregoing configuration makes it possible to prepare micro-nanobubbles by effectively self-supplying, mixing, and solving the liquid and gas and pressure-feeding the mixture.

Further, as with the microbubble generating device 65, the micro-nanobubble generating device 66 is not limited in location where it is installed, as long as the micro-nanobubble generator 13 can suck in the microbubble-containing liquid introduced into the micro-nanobubble generation tank 11 and prepare micro-nanobubble-containing water. Further, the micro-nanobubble generation tank 11 and the micro-nanobubble generating device 66 do not need to be formed integrally, and can be realized by a combination of separate members.

The micro-nanobubble generator 13 is not limited as long as it can turn microbubbles contained in the microbubble-containing liquid into finer micro-nanobubbles; however, it is preferable that the micro-nanobubble generator 13 have a second shearing section. This makes it possible to easily turn the microbubbles into smaller micro-nanobubbles.

The circulating pump 15 generates a multiphase swirling flow of the micro-nanobubble-containing liquid, which is a mixture of a liquid and a gas, and thereby forms, in the central part of the micro-nanobubble generator 13, a gas cavity portion in which the multiphase swirling flow swirls at a high speed. Such a circulating pump 15 may take, but is not limited to, the form of the aforementioned high-lift pump. Further, the circulating pump 15 is connected to the suction pipe 14 so as to suck in the microbubble-containing liquid through the suction pipe 14. Further, the circulating pump 15 supplies the microbubble-containing liquid, sucked in through the suction pipe 14, to the micro-nanobubble generator 13 through the liquid pipe 18.

Further, it is preferable that the micro-nanobubble generating device 66 according to the present embodiment include the gas needle valve 17 through which gas (second supplied gas) is supplied to the micro-nanobubble generator 13. This makes it possible that a micro-nanobubble-containing liquid containing a larger amount of micro-nanobubbles is prepared by further mixing the gas into the microbubble-containing liquid prepared in the microbubble generating device 65 and shearing the mixture. Therefore, in the final result, a nanobubble-containing liquid containing a large amount nanobubbles can be efficiently prepared. Examples of such gas include, but are not limited to, air, ozone gas, carbon dioxide gas, nitrogen gas, and oxygen gas. The gas needle valve 17 and the micro-nanobubble generator 13 are connected via the gas pipe 16.

Further, the overflow pipe 19 is connected to the micro-nanobubble generation tank 11 and the nanobubble generation tank 20, and the micro-nanobubble-containing liquid prepared in the micro-nanobubble generation tank 11 is introduced into the nanobubble generation tank 20 by overflow through the overflow pipe 19.

The nanobubble generation tank 20 is a tank in which a nanobubble-containing liquid is prepared, and includes a nanobubble generating device (third nanobubble-containing liquid preparing means) 67 and an overflow pipe 28.

The nanobubble generation tank 20 is not particularly limited in specific configuration, and may be configured, for example, such that the micro-nanobubble-containing liquid is introduced from the micro-nanobubble generation tank 11 through the overflow pipe 19 and the micro-nanobubble-containing liquid (third fine-bubble-containing liquid) is prepared by the nanobubble generating device 67.

The nanobubble generating device 67 is a device that prepares the nanobubble-containing liquid (third fine-bubble-containing liquid) with use of the micro-nanobubble-containing liquid introduced into the nanobubble generation tank 20 and discharges the nanobubble-containing liquid into the nanobubble generation tank 20, and includes a suction pipe 23, a circulating pump 24, a gas pipe 25, a gas needle valve (third gas supply means) 26, a liquid pipe 27, and a nanobubble generator 22.

The nanobubble generating device 67 is not particularly limited in specific configuration, but may configured in the same manner as the micro-nanobubble generating device 66. That is, the nanobubble generating device 67 may include the circulating pump 24 in the form of a high-lift pump. The foregoing configuration makes it possible to prepare nanobubbles by effectively self-supplying, mixing, and solving the liquid and gas, pressure-feeding their mixture to mix the liquid and gas, and then shearing the mixture.

Further, as with the microbubble generating device 65, the nanobubble generating device 67 is not limited in location where it is installed, as long as the nanobubble generating device 67 can suck in the micro-nanobubble-containing liquid introduced into the nanobubble generation tank 20 and prepare micro-nanobubble-containing water. Further, the nanobubble generation tank 20 and the nanobubble generating device 67 do not need to be formed integrally, and can be constituted by a combination of separate members.

The nanobubble generator 22 is not limited as long as it can turn micro-nanobubbles contained in the micro-nanobubble-containing liquid into finer nanobubbles; however, it is preferable that the nanobubble generator 22 have a third shearing section. This makes it possible to easily turn the micro-nanobubbles into smaller nanobubbles.

The circulating pump 24 generates a multiphase swirling flow of the micro-nanobubble-containing liquid, which is a mixture of a liquid and a gas, and thereby forms, in the central part of the nanobubble generator 22, a gas cavity portion in which the multiphase swirling flow swirls at a high speed. Such a circulating pump 24 may take, but is not limited to, the form of the aforementioned high-lift pump. Further, the circulating pump 24 is connected to the suction pipe 23 so as to suck in the micro-nanobubble-containing liquid through the suction pipe 23. Further, the circulating pump 24 supplies the micro-nanobubble-containing liquid, sucked in through the suction pipe 23, to the nanobubble generator 22 through the liquid pipe 27.

Further, it is preferable that the nanobubble generating device 67 according to the present embodiment include the gas needle valve 26 through which gas (third supplied gas) is supplied to the nanobubble generator 22. This makes it possible to accurately control the amount of gas. Moreover, a nanobubble-containing liquid containing a larger amount of nanobubbles can be prepared by further mixing the gas into the micro-nanobubble-containing liquid prepared in the micro-nanobubble generating device 66 and shearing the mixture. Examples of such gas include, but are not limited to, air, ozone gas, carbon dioxide gas, nitrogen gas, and oxygen gas. The gas needle valve 26 and the nanobubble generator 22 are connected via the gas pipe 25.

Further, the overflow pipe 28 connects the nanobubble generation tank 20 to the measuring tank 29, and the nanobubble-containing liquid prepared in the nanobubble generation tank 20 is transferred into the measuring tank 29 by overflow through the overflow pipe 28.

The measuring tank 29 is a tank into which the nanobubble-containing liquid prepared in the nanobubble generation tank 20 is introduced. The measuring tank 29 is not particularly limited in specific configuration; however, it is preferable that the measuring tank 29 include nanobubble content measuring means that measures the nanobubble content of the nanobubble-containing liquid introduced from the nanobubble generation tank 20. This makes it possible, for example, to measure the nanobubble content of the nanobubble-containing liquid, thus making it possible to easily prepare a nanobubble-containing liquid containing a desired amount of nanobubbles. That is, the nanobubble content of a nanobubble-containing liquid to be prepared can be easily adjusted.

An example of the nanobubble content measuring means may be, but is not limited to, zeta potential measuring means or a Coulter counter. The measuring tank 29 according to the present embodiment includes an oxidation-reduction potential detecting section 30, which is oxidation-reduction potential detecting means, and an oxidation-reduction potential regulator 68 (each manufactured by DKK-TOA Corporation).

In the present embodiment, the oxidation-reduction potential detecting means measures the oxidation-reduction potential of the nanobubble-containing liquid introduced into the measuring tank 29. This is based on the fact that the oxidation-reduction potential of a nanobubble-containing liquid is correlated with the nanobubble content of the nanobubble-containing liquid. That is, this is based on the fact that since nanobubbles are oxidative to matter, the oxidation-reduction potential of a nanobubble-containing liquid to be measured varies depending on the type of liquid containing nanobubbles, the number of nanobubbles, and the density of nanobubbles. In the present embodiment, the oxidation-reduction potential detecting means is run within, but is not limited to, a positive millivolt range of +20 mV to +120 mV. For example, in the case of measurement of the oxidation-reduction potential of a liquid in a denitrification tank (i.e., a reducing tank) for use in wastewater treatment, the oxidation-reduction potential detecting means may be run within a negative millivolt range of −50 mV to −400 mV.

Specifically, the measurement is performed as follows: First, the oxidation-reduction potential detecting section 30 detects the oxidation-reduction potential of the nanobubble-containing liquid introduced into the measuring tank 29. Next, the oxidation-reduction potential regulator 68 measures the nanobubble content of the nanobubble-containing liquid in accordance with the value of the oxidation-reduction potential thus detected. Then, the oxidation-reduction potential regulator 68 produces a signal indicative of the oxidation-reduction potential correlated with the nanobubble content thus measured, and sends the signal to the sequencer 31, which is described below.

The sequencer 31 is control means that controls, in accordance with the oxidation-reduction potential correlated with the nanobubble content of the nanobubble-containing liquid, the amounts of a surfactant and a mineral salt that are supplied to each bubble generation tank.

The sequencer 31 is not particularly limited in specific configuration. For example, the sequence 31 only needs to be connected to the oxidation-reduction potential detecting section 30, the oxidation-reduction potential regulator 68, surfactant metering pumps (first metering pump 33, second metering pump 34, third metering pump 35), and mineral salt metering pumps (fourth metering pump 38, fifth metering pump 39, sixth metering pump 40) via a signal line 52. This makes it possible that the amounts of the surfactant and the mineral salt that are supplied by the surfactant metering pumps and the mineral salt metering pumps are regulated by sending a signal to each member connected via the signal line 52, in accordance with the oxidation-reduction potential sent from the oxidation-reduction potential regulator 68 and correlated with the nanobubble content, so that the members run in cooperation with one another. Specifically, in cases where the nanobubble content is insufficient, i.e., in cases where the oxidation-reduction potential is lower than a set value, first, the sequencer 31 sends signals to the surfactant metering pumps (first metering pump 33, second metering pump 34, third metering pump 35) and the mineral salt metering pumps (fourth metering pump 38, fifth metering pump 39, sixth metering pump 40) via the signal line 52. Next, the sequencer 31 instructs the surfactant metering pumps and the mineral salt metering pumps to supply the surfactant and the mineral salt to each bubble generation tank, in order that the oxidation-reduction potential takes on the set value. This results in a rise of the oxidation-reduction potential to the set value, thus enabling an increase in the nanobubble content.

The surfactant tank 32 is a tank having the surfactant stored therein, and the surfactant stored in this tank is supplied to each bubble generation tank. The surfactant tank 32 includes a first stirring machine 36 for stirring the surfactant stored in the surfactant tank 32. The concentration of the surfactant can be equalized within the surfactant tank 32 by using the first stirring machine 36 to stir the surfactant stored in the surfactant tank 32. The surfactant stored in the surfactant tank 32 is supplied to the microbubble generation tank 5, the micro-nanobubble generation tank 11, and the nanobubble generation tank 20 through chemical pipes (surfactant supply means) 43, 44, and 45 by opening and closing the first metering pump 33, the second metering pump 34, and the third metering pump 35.

The foregoing configuration makes it possible that a nanobubble-containing liquid containing a larger amount of nanobubbles is prepared by supplying, to at least one of the microbubble generation tank 5, the micro-nanobubble generation tank 11, and the nanobubble generation tank 20, the surfactant introduced into the surfactant tank 32. It should be noted here that since the surfactant is a substance that reduces interfacial tension, the amount of bubbles that are contained in the microbubble-containing liquid, the amount of bubbles that are contained in the micro-nanobubble-containing liquid, and the amount of bubbles that are contained in the nanobubble-containing liquid can be increased by supplying the surfactant to at least one of the microbubble generation tank 5, the micro-nanobubble generation tank 11, and the nanobubble generation tank 20, into which the microbubble-containing liquid, the micro-nanobubble-containing liquid, and the nanobubble-containing liquid are discharged, respectively. As a result, a nanobubble-containing liquid containing a large amount of nanobubbles can be obtained in the nanobubble generation tank 20, which is the last tank.

The installation of the first to third metering pumps in the surfactant tank 32 makes it possible to easily regulate the amount of the surfactant that is supplied to the microbubble generation tank 5, the amount of the surfactant that is supplied to the micro-nanobubble generation tank 11, and the amount of the surfactant that is supplied to the nanobubble generation tank 20, thus making it possible to easily regulate the nanobubble content of the nanobubble-containing liquid thus prepared.

Further, examples of the surfactant include, but are not limited to, a cationic surfactant, an anionic surfactant, and a nonionic surfactant. The amount of the surfactant that is added is not particularly limited, but may be appropriately changed depending on the type of liquid in which nanobubbles are to be generated.

The mineral salt tank 37 is a tank having the inorganic salt stored therein, and the inorganic salt stored in this tank is supplied to each bubble generation tank. In this specification, the inorganic salt is referred to also as "mineral salt", and is intended to mean inorganic salts such as a calcium salt, a sodium salt, and a magnesium salt. The mineral salt tank 37 includes a second stirring machine 41 for stirring the inorganic salt stored in the mineral salt tank 37. The concentration of the inorganic salt can be equalized within the mineral salt tank 37 by using the second stirring machine 41 to stir the inorganic salt stored in the mineral salt tank 37. The inorganic salt stored in the mineral salt tank 37 is supplied to the microbubble generation tank 5, the micro-nanobubble generation tank 11, and the nanobubble generation tank 20 through chemical pipes (inorganic salt supply means) 42, 46, and 47 by opening and closing the fourth metering pump 38, the fifth metering pump 39, and the sixth metering pump 40.

The foregoing configuration makes it possible that a nanobubble-containing liquid containing a larger amount of nanobubbles can be prepared by supplying, to at least one of the microbubble generation tank 5, the micro-nanobubble generation tank 11, and the nanobubble generation tank 20, the inorganic salt introduced into the mineral salt tank 37. It should be noted here that since addition of the inorganic salt to a liquid turns the liquid into an electrolyte in which bubbles are easily generated, the amount of bubbles that are contained in the microbubble-containing liquid, the amount of bubbles that are contained in the micro-nanobubble-containing liquid, and the amount of bubbles that are contained in the nanobubble-containing liquid can be increased by supplying the inorganic salt to at least one of the microbubble generation tank 5, the micro-nanobubble generation tank 11, and the nanobubble generation tank 20, into which the microbubble-containing liquid, the micro-nanobubble-containing liquid, and the nanobubble-containing liquid are discharged, respectively. As a result, a nanobubble-containing liquid containing a large amount of nanobubbles can be obtained in the nanobubble generation tank 20, which is the last tank.

The installation of the fourth to sixth metering pumps in the mineral salt tank 37 makes it possible to easily regulate the amount of the inorganic salt that is supplied to the microbubble generation tank 5, the amount of the inorganic salt that is supplied to the micro-nanobubble generation tank 11, and the amount of the inorganic salt that is supplied to the nanobubble generation tank 20, thus making it possible to easily regulate the nanobubble content of the nanobubble-containing liquid thus prepared. The amount of the inorganic salt that is added is not particularly limited, but may be appropriately changed depending on the type of liquid in which nanobubbles are to be generated.

The nanobubble-containing liquid tank 49 is a tank into which the nanobubble-containing liquid thus prepared is introduced from the measuring tank 29 through the overflow pipe 48. The nanobubble-containing liquid stored in the nanobubble-containing liquid tank 49 is transferred to a subsequent-step apparatus 51 by running a second transfer pump (second transfer means) 50.

Examples of the subsequent-step apparatus 50 include, but are not limited to, a biological apparatus, a chemical apparatus, a physical apparatus, and a bathtub apparatus. Use of the nanobubble-containing liquid in biological apparatuses increases the activity of living organisms associated various biological apparatuses, thus making it possible to enhance biological reactions. For example, use of the nanobubble-containing liquid in a biological apparatus for use in breeding makes it possible to improve the growth rate of fish to be bred. Use of the nanobubble-containing liquid in a biological apparatus for use in tank farming makes it possible to accelerate the growth of plants. Furthermore, use of the nanobubble-containing liquid in wastewater treatment in a biological apparatus activates microorganisms in the wastewater, thus making it possible to improve the quality of treated water or the capacity of treatment while stabilizing the treatment.

Further, use of the prepared nanobubble-containing liquid in chemical apparatuses makes it possible to enhance the reaction efficiency of chemical reactions related to various chemical apparatuses.

Further, use of the prepared nanobubble-containing liquid in physical apparatuses makes it possible to enhance physical action related to various physical apparatuses. For example, use of the nanobubble-containing liquid in a physical apparatus serving as an activated carbon adsorbing apparatus increase the adsorption of activated carbon. Furthermore, the use of the nanobubble-containing liquid in the apparatus causes a phenomenon in which microorganisms having proliferated in the activated carbon degrade organic matter adsorbed by the activated carbon. That is, the activated carbon is automatically recycled by the microorganisms.

Furthermore, in the case of use of the prepared nanobubble-containing liquid in a bathtub apparatus, the medical effects such as the effect of hyperthermia of bathwater, the cleansing effect on human skins, and the action of increase in blood flow of human bodies can be expected.

<Method for Producing a Nanobubble-Containing Liquid>

The following describes an example of a method according to the present invention for producing a nanobubble-containing liquid. The nanobubble-containing liquid is prepared through three main steps (microbubble-containing liquid preparing step, micro-nanobubble-containing liquid preparing step, nanobubble-containing liquid preparing step). It should be noted that although the producing steps are described below with reference to a nanobubble-containing liquid producing apparatus according to the present embodiment, the present invention is not limited to this.

(Microbubble-Containing Liquid Preparing Step)

The microbubble-containing liquid preparing step is a step of preparing a microbubble-containing liquid with use of a liquid introduced into the microbubble generation tank 5.

In the microbubble-containing liquid preparing step, first, the liquid is introduced from the water storage tank 1 through the liquid pipe 4. At this point, as with an ordinary submerged pump, the submerged-pump microbubble generator 6 employed in the microbubble generating device 65 according to the present invention shares supplied gas by rotating the impeller section (i.e., the lower part of the microbubble generator 6 in FIG. 1) at a high speed and thereby generates microbubbles. Specifically, first, the impeller section of the submerged pump is rotated at a high speed in the microbubble generation tank 5, into which the liquid has been introduced. After that, the small-sized blower 7 supplies gas to the impeller section through the gas pipe 8. The amount of the gas that is supplied is not particularly limited, and may be 2 to 5 liter/minute, for example. Furthermore, the gas is mixed into the liquid stored in the microbubble generation tank 5, and the mixture is sheared by rotating the impeller section at a high speed, whereby microbubbles are prepared. The number of rotations of the impeller section is not particularly limited here; however, it is more preferable, for example, that the number of rotations of the impeller section be 500 to 600 rotations/second. The microbubble-containing liquid thus prepared is discharged into the microbubble generation tank 5, whereby a bubble liquid current 9 is generated.

At this point, in cases where a nanobubble-containing liquid has already been prepared in the nanobubble generation tank 20 of the nanobubble-containing liquid producing apparatus 64 and the oxidation-reduction potential of the nanobubble-containing liquid as measured in the measuring tank 29 is low, the surfactant and the mineral salt can be supplied into the microbubble generation tank through the chemical pipes 43 and 42 from the surfactant tank 32 and the mineral salt tank 37, respectively. The supply of the surfactant and the mineral salt can be controlled by the sequencer 31. Whether the surfactant or the mineral salt is supplied only needs to be appropriately determined depending the two types of liquid, and either or both of the surfactant and the mineral salt may be supplied. It should be noted that the addition of the surfactant or the mineral salt causes the liquid to become clouded like milk, albeit with some variation depending on the amount added. This makes it possible to increase the microbubble content of the microbubble-containing liquid.

Further, there is no particular limitation on how the microbubbles are generated. For example, the microbubbles may be generated by a high-speed rotation stirring microbubble generator, a cavitation microbubble generator, a pressure-solution microbubble generator, a turbulent-shear microbubble generator, or a swirling-flow microbubble generator. That is, the microbubble generating device 65 is commercially available as a cavitation system, a pressure-solution system, a turbulent-shear system, a high-speed-rotation-stirring system, or a swirling-flow system, and they are rich in versatility. Therefore, the nanobubble-containing liquid producing apparatus according to the present invention can be easily manufactured by employing any one of such systems for generating microbubbles.

The microbubble-containing liquid thus prepared may be introduced into the micro-nanobubble generation tank 11 through the overflow pipe 10. That is, the liquid is transferred from the water storage tank 1 into the microbubble generation tank 5 by the first transfer pump 3, which is run continuously so that the liquid can be introduced from the microbubble generation tank 5 into the micro-nanobubble generation tank 11 in such a way as to flow out of the microbubble generation tank 5. The discharge pressure of the first transfer pump 3 is not particularly limited, but is preferably 1.3 to 1.5 kg/cm$^2$.

(Micro-Nanobubble-Containing Liquid Preparing Step)

The micro-nanobubble-containing liquid preparing step is a step of preparing a micro-nanobubble-containing liquid with use of the microbubble-containing liquid introduced into the micro-nanobubble generation tank 11.

In the micro-nanobubble-containing liquid preparing step, first, a negative pressure portion is formed in the central part of the micro-nanobubble generator 13 by generating a multiphase swirling flow of the microbubble-containing liquid, which is introduced into the circulating pump 15 through the suction pipe 14, in the micro-nanobubble generation tank 11, into which the microbubble-containing liquid has been introduced, whereby a gas cavity portion is formed in which the multiphase swirling flow swirls at a high speed. The term "negative pressure portion" means an area in the mixture of the microbubbles and the liquid that is lower in pressure than the area therearound. After that, the gas cavity portion is thinned down into the form of a tornado through regulation of pressure by the circulating pump 15, whereby a rotating shear flow is generated which swirls at a higher speed. At this point, the gas cavity portion is supplied with gas from the gas needle valve 17 through the gas pipe 16. As mentioned above, examples of the gas include air, ozone gas, carbon dioxide gas, nitrogen gas, and oxygen gas. Further, the gas may be automatically supplied with use of a negative pressure. The gas thus supplied is cut and crushed by the second shearing section (not shown) of the micro-nanobubble generator 13, and the multiphase flow is rotated. The cutting and crushing by the second shearing section may be carried out using a difference in swirling speed of a gas-liquid two-phase flow between inside and outside of the device near the outlet of the micro-nanobubble generator 13. At this point, the swirling speed is, but is not limited to, 500 to 600 rotations/second. Thus, the microbubbles contained in the microbubble-containing liquid are further sheared, whereby micro-nanobubbles are prepared. The micro-nanobubble-containing liquid thus prepared is discharged into the micro-nanobubble generation tank 11, whereby a bubble liquid current 12 is generated.

At this point, in cases where a nanobubble-containing liquid has already been prepared in the nanobubble generation tank 20 of the nanobubble-containing liquid producing apparatus 64 and the oxidation-reduction potential of the nanobubble-containing liquid as measured in the measuring tank 29 falls short of the target level, the surfactant and the mineral salt can be supplied into the micro-nanobubble generation tank 11 through the chemical pipes 44 and 46 from the surfactant tank 32 and the mineral salt tank 37, respectively. The supply of the surfactant and the mineral salt can be controlled by the sequencer 31. Whether the surfactant or the mineral salt is supplied only needs to be appropriately selected and determined depending the type of liquid, and either or both of the surfactant and the mineral salt may be supplied. It should be noted that the addition of the surfactant or the mineral salt causes the liquid to become clouded like milk, albeit with some variation depending on the amount added. This makes it possible to increase the micro-nanobubble content of the micro-nanobubble-containing liquid.

In the present embodiment, the circulating pump 15 takes, but is not limited to, the form of a high-lift pump having a lifting height of not less than 15 m (i.e., a high pressure of 1.5 kg/cm$^2$). For example, the circulating pump 15 may be a high-lift pump having a two-pole pump stable in torque. Furthermore, in cases where the circulating pump 15 takes the form of a high-lift pump, it is preferable that the high-lift pump include a number-of-rotations controller. This makes it possible to control the number of rotations of the high-lift pump by the number-of-rotations controller and thereby changing the pressure of the high-lift pump for any purpose. As a result, micro-nanobubbles smaller in size can be prepared.

The micro-nanobubble-containing liquid thus prepared may be transferred into the nanobubble generation tank 20 through the overflow pipe 19. That is, the first transfer pump 3 is run continuously so that the micro-nanobubble-containing liquid can be transferred from the micro-nanobubble generation tank 11 into the nanobubble generation tank 20 in such a way as to flow out of the micro-nanobubble generation tank 11.

(Nanobubble-Containing Liquid Preparing Step)

The nanobubble-containing liquid preparing step is a step of preparing a nanobubble-containing liquid with use of the micro-nanobubble-containing liquid introduced into the nanobubble generation tank 20.

In the nanobubble-containing liquid preparing step, first, a negative pressure portion is formed in the central part of the nanobubble generator 22 by generating a multiphase swirling flow of the micro-nanobubble-containing liquid, which is introduced into the circulating pump 24 through the suction pipe 23, in the nanobubble generation tank 20, into which the micro-nanobubble-containing liquid has been introduced, whereby a gas cavity portion is formed in which the multiphase swirling flow swirls at a high speed. After that, the gas cavity portion is thinned down into the form of a tornado through regulation of pressure by the circulating pump 24, whereby a rotating shear flow is generated which swirls at a higher speed. At this point, the gas cavity portion is supplied with gas from the gas needle valve 26 through the gas pipe 25. As mentioned above, examples of the gas include air, ozone gas, carbon dioxide gas, nitrogen gas, and oxygen gas. Further, the gas may be automatically supplied with use of a negative pressure. The gas thus supplied is cut and crushed by the third shearing section (not shown) of the nanobubble generator 22, and the multiphase flow is rotated. The cutting and crushing by the third shearing section may be carried out using a difference in swirling speed of a gas-liquid two-phase flow between inside and outside of the device near the outlet of the nanobubble generator 22. At this point, the swirling speed is, but is not limited to, 500 to 600 rotations/second. Thus, the micro-nanobubbles contained in the micro-nanobubble-containing liquid are further sheared, whereby nanobubbles are prepared. The nanobubble-containing liquid thus prepared is discharged into the nanobubble generation tank 20, whereby a bubble liquid current 21 is generated.

At this point, in cases where a nanobubble-containing liquid has already been prepared in the nanobubble generation tank 20 of the nanobubble-containing liquid producing apparatus 64 and the oxidation-reduction potential of the nanobubble-containing liquid as measured in the measuring tank 29 falls short of the target level, the surfactant and the mineral salt can be supplied into the nanobubble generation tank 20 through the chemical pipes 45 and 47 from the surfactant tank 32 and the mineral salt tank 37, respectively. The supply of the surfactant and the mineral salt can be controlled by the sequencer 31. Whether the surfactant or the mineral salt is supplied only needs to be appropriately selected depending the type of liquid, and either or both of the surfactant and the mineral salt may be supplied. It should be noted that the addition of the surfactant or the mineral salt causes the liquid to become clouded like milk, albeit with some variation depending on the amount added. This makes it possible to increase the nanobubble content of the nanobubble-containing liquid.

In the present embodiment, as with the circulating pump 15, the circulating pump 24 takes, but is not limited to, the form of a high-lift pump having a lifting height of not less than 15 m (i.e., a high pressure of 1.5 kg/cm$^2$). For example, the circulating pump 24 may be a high-lift pump having a two-pole pump stable in torque. Furthermore, in cases where the circulating pump 24 takes the form of a high-lift pump, it is preferable that the high-lift pump include a number-of-rotations controller. This makes it possible to control the number of rotations of the high-lift pump by the number-of-rotations controller and thereby changing the pressure of the high-lift pump for any purpose. As a result, nanobubbles smaller in size can be prepared.

The nanobubble-containing liquid thus prepared may be transferred into the measuring tank 29 through the overflow pipe 28, or may be transferred directly into the nanobubble-containing liquid tank 49.

As describe above, the nanobubble-containing liquid producing method according to the present embodiment prepares the nanobubble-containing liquid through the microbubble-containing liquid preparing step, the micro-nanobubble-containing liquid preparing step, and the nanobubble-containing liquid preparing step. In the present embodiment, the micro-nanobubble generating device 66 and the nanobubble generating device 67 are supplied with gas, too. However, the present embodiment is not limited to this. It may be that only the microbubble generating device 65 is supplied with gas and the microbubbles contained in the microbubble-containing liquid prepared by the device is sized down in the micro-nanobubble generating device 66 and the nanobubble generating device 67.

As described above, a nanobubble-containing liquid producing apparatus 64 includes: a microbubble generating device 65 that prepares a microbubble-containing liquid with use of a liquid introduced into a microbubble generation tank 5 and discharges the microbubble-containing liquid into the microbubble generation tank 5; a micro-nanobubble generating device 66 that prepares a micro-nanobubble-containing liquid with use of the microbubble-containing liquid introduced into a micro-nanobubble generation tank 11 and discharges the micro-nanobubble-containing liquid into the micro-nanobubble generation tank 11; and a nanobubble generating device 67 that prepares a nanobubble-containing liquid with use of the micro-nanobubble-containing liquid introduced into nanobubble generation tank 20 and discharges the nanobubble-containing liquid into the nanobubble generation tank 20. Therefore, by introducing a liquid sequentially from first to third tanks disposed in series and actuating the microbubble generating device 65, the micro-nanobubble generating device 66, and the nanobubble-generating device 67, a nanobubble-containing liquid can be obtained in the third tank, which is the last tank.

Further, the microbubble generating device 65, the micro-nanobubble generating device 66, and the nanobubble generating device 67 can all be realized by microbubble generating devices, not by nanobubble generating devices complex in structure. Therefore, the cost of manufacturing the apparatus is reduced, and the apparatus can be manufactured in a short period of time.

Second Embodiment

Figure 2:
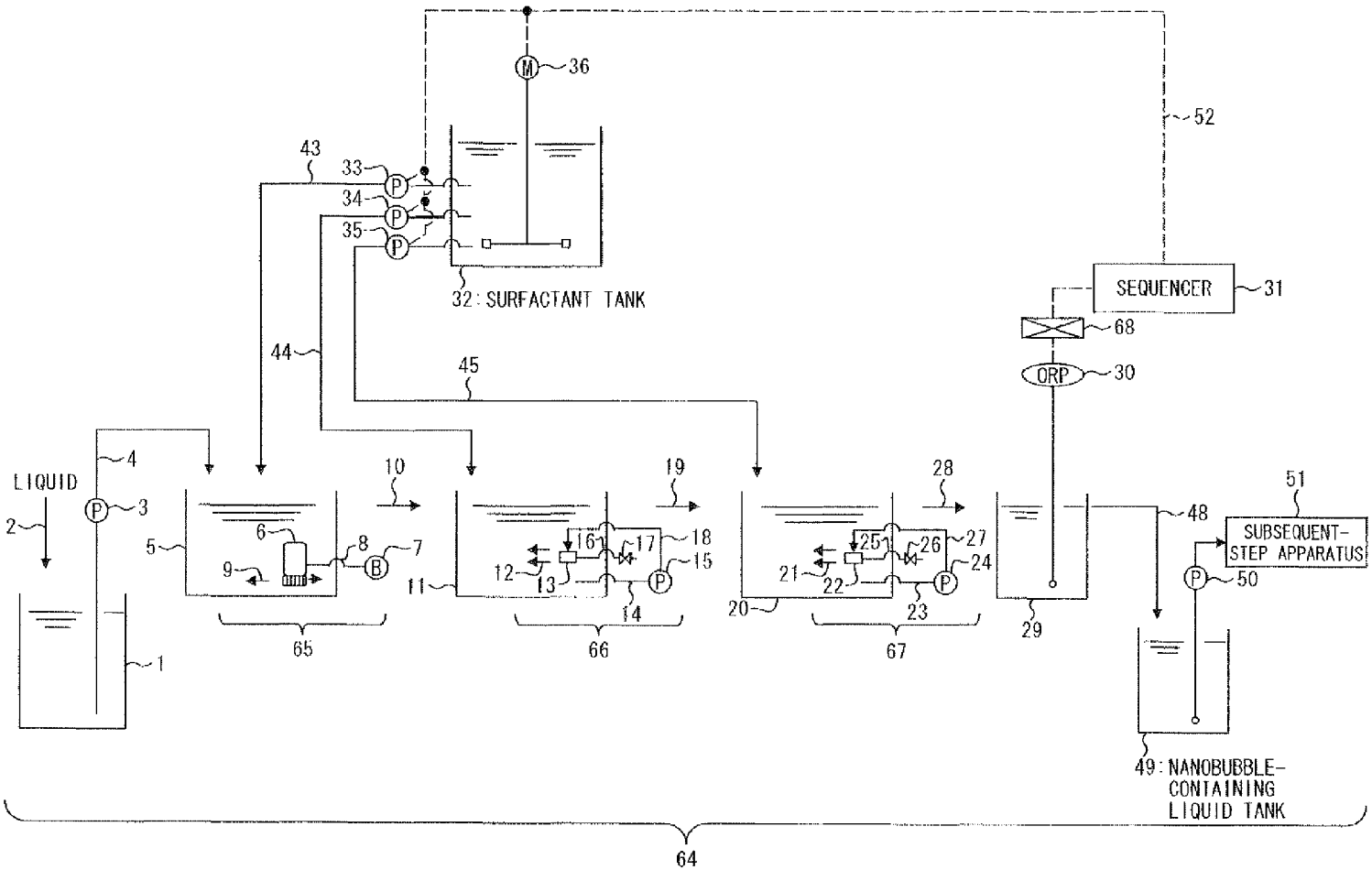
FIG. 2 is a pattern diagram showing a second embodiment of a nanobubble-containing liquid producing apparatus according to the present invention.

A second embodiment of a nanobubble-containing liquid producing apparatus according to the present invention is described below with reference to FIG. 2. FIG. 2 is a pattern diagram schematically showing the configuration of a nanobubble-containing liquid producing apparatus according to the second embodiment. The second embodiment is configured in the same manner as the first embodiment, except that the mineral salt tank 37 and the members therearound (the fourth metering pump 38, the fifth metering pump 39, the sixth metering pump 40, and the chemical pipes 42, 46, and 47) are not installed.

In present embodiment, since the mineral salt tank 37 is not installed, no mineral salt is supplied to each bubble generation tank. However, depending on the type of liquid, it is not necessary to add a mineral salt, and a large amount of each type of bubble can be generated in each bubble-containing liquid simply by adding a surfactant.

Third Embodiment

Figure 3:
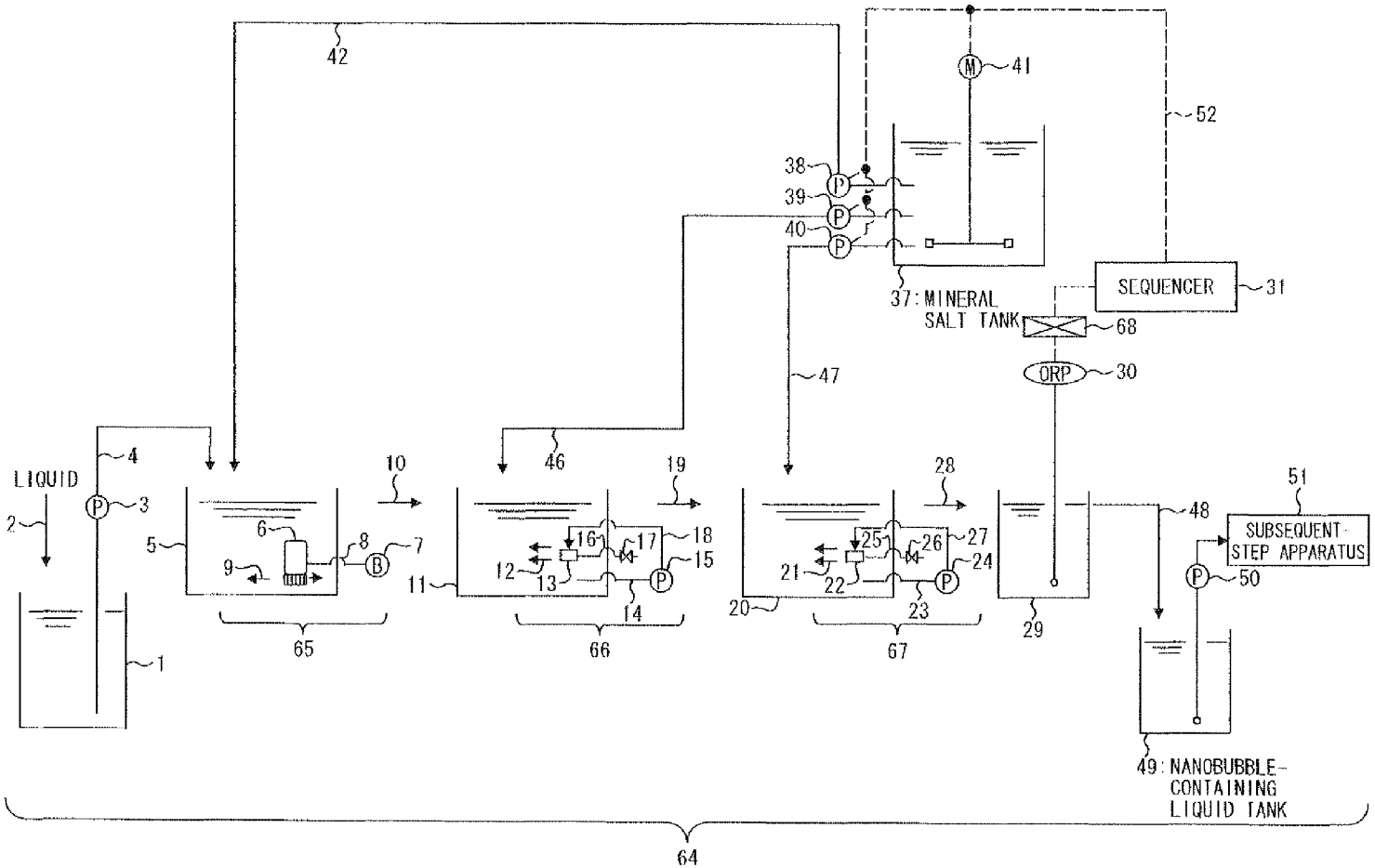
FIG. 3 is a pattern diagram showing a third embodiment of a nanobubble-containing liquid producing apparatus according to the present invention.

A third embodiment of a nanobubble-containing liquid producing apparatus according to the present invention is described below with reference to FIG. 3. FIG. 3 is a pattern diagram schematically showing the configuration of a nanobubble-containing liquid producing apparatus according to the third embodiment. The third embodiment is configured in the same manner as the first embodiment, except that the surfactant tank 32 and the members therearound (the first metering pump 33, the second metering pump 34, the third metering pump 35, and the chemical pipes 43, 44, and 45) are not installed.

In present embodiment, since the surfactant tank 32 is not installed, no surfactant is supplied to each bubble generation tank. However, depending on the type of liquid, it is not necessary to add a surfactant, and a large amount of each type of bubble can be generated in each bubble-containing liquid simply by adding a mineral salt.

Fourth Embodiment

Figure 4:
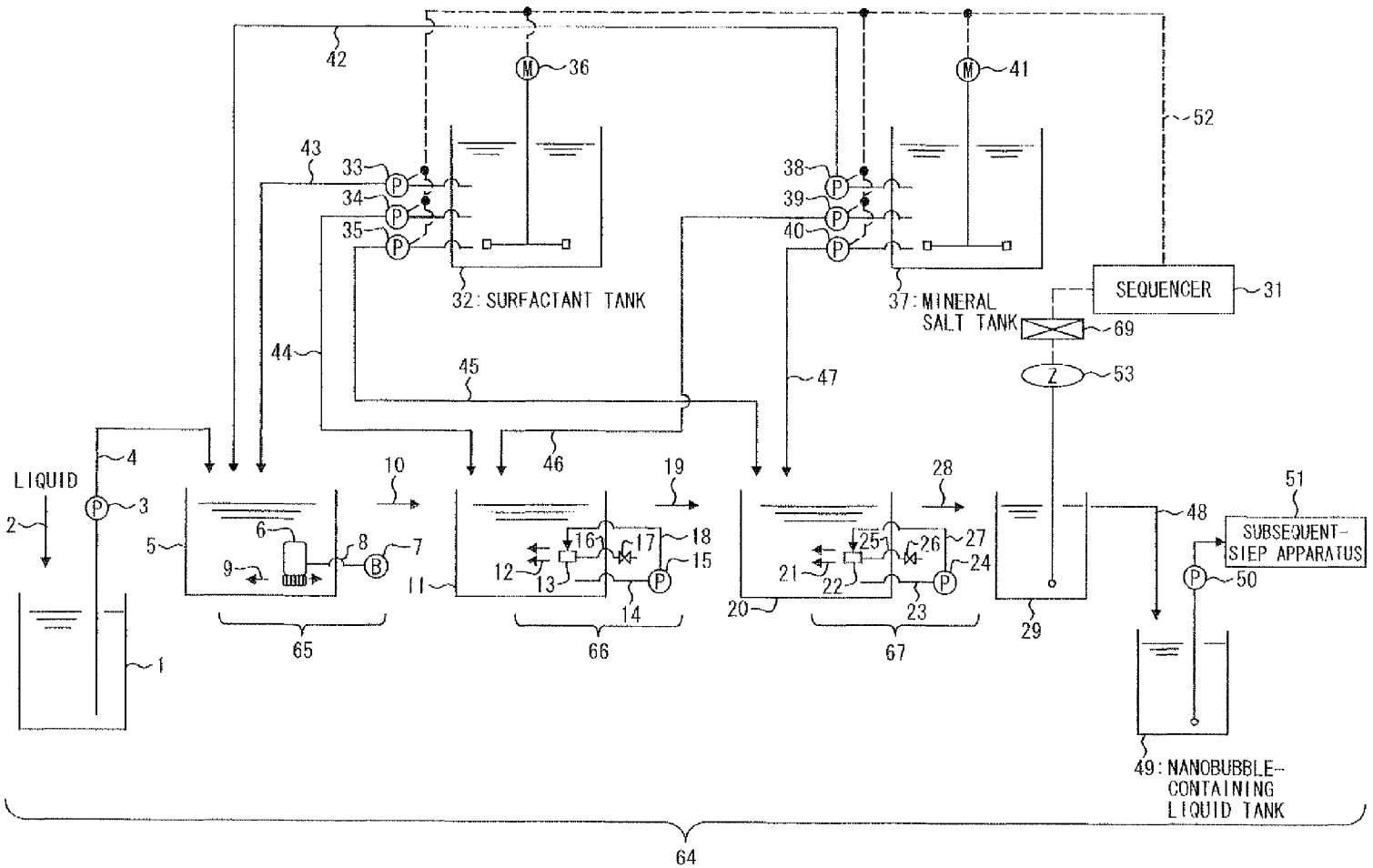
FIG. 4 is a pattern diagram showing a fourth embodiment of a nanobubble-containing liquid producing apparatus according to the present invention.

A fourth embodiment of a nanobubble-containing liquid producing apparatus according to the present invention is described below with reference to FIG. 4. FIG. 4 is a pattern diagram schematically showing the configuration of a nanobubble-containing liquid producing apparatus according to the fourth embodiment. The fourth embodiment is configured in the same manner as the first embodiment, except that the oxidation-reduction potential detecting section 30 and the oxidation-reduction potential regulator 68 of the first embodiment are replaced by a zeta potential detecting section 53 and a zeta potential regulator 69.

In general, the "zeta potential" is defined as "the electrical potential that exists across the glide plane of an electrical double layer formed by a surface potential". As with the oxidation-reduction potential, the zeta potential is correlated with the nanobubble content of a nanobubble-containing liquid, and can serve as means for controlling the nanobubble content.

The zeta potential detecting section 53 and the zeta potential regulator 69 are not particularly limited, but may be, e.g., "Zeta Potential Analyzers Model DT" manufactured by Nihon Rufuto Co., Ltd. Further, the nanobubble content of the nanobubble-containing liquid can be such that the zeta potential falls within a range of −30 mV to −70 mV, for example, albeit with some variation depending on the type of liquid.

Fifth Embodiment

Figure 5:
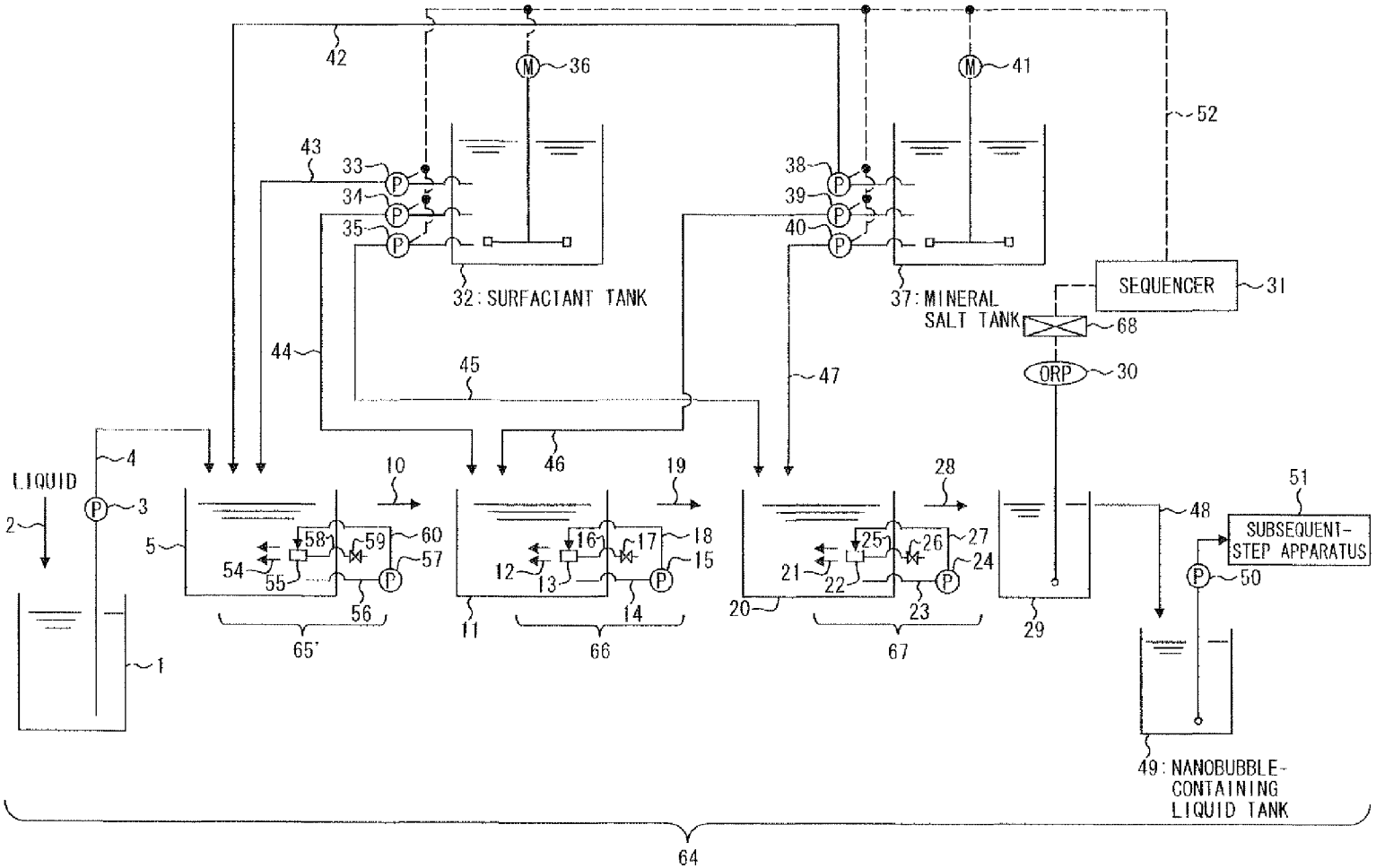
FIG. 5 is a pattern diagram showing a fifth embodiment of a nanobubble-containing liquid producing apparatus according to the present invention.

A fifth embodiment of a nanobubble-containing liquid producing apparatus according to the present invention is described below with reference to FIG. 5, FIG. 5 is a pattern diagram schematically showing the configuration of a nanobubble-containing liquid producing apparatus 64 according to the fifth embodiment. The fifth embodiment is configured in the same manner as the first embodiment, except that a microbubble generating device 65' constituted by a microbubble generator 55, a circulating pump 57, and the like is installed, whereas the microbubble generating device 65 constituted by the submerged-pump microbubble generator 6 and the like is installed in the first embodiment.

Since the microbubble generating device 65' constituted by the circulating pump 57 and the like is installed, the present embodiment can generate microbubbles smaller, i.e., finer than those generated by the submerged-pump microbubble generator 6. This makes it possible to obtain nanobubbles smaller in size than those obtained in the nanobubble-containing liquid tank 49 of the first embodiment. It should be noted here that since it is experimentally known that microbubbles or nanobubbles finer in size bring about greater effects, it is useful to employ the present embodiment in a nanobubble-containing liquid producing apparatus of the present invention.

Sixth Embodiment

Figure 6:
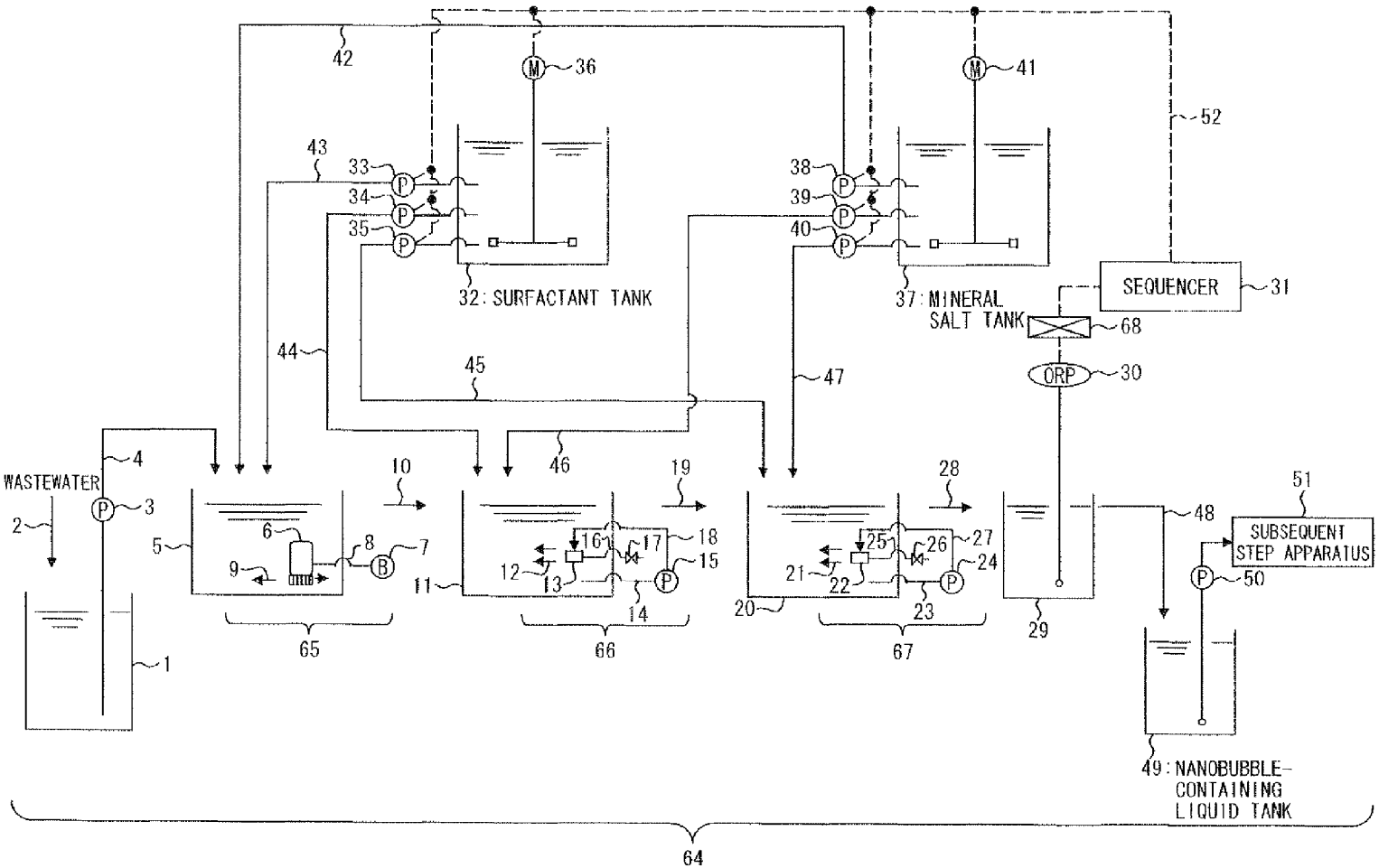
FIG. 6 is a pattern diagram showing a sixth embodiment of a nanobubble-containing liquid producing apparatus according to the present invention.

A sixth embodiment of a nanobubble-containing liquid producing apparatus according to the present invention is described below with reference to FIG. 6. FIG. 6 is a pattern diagram schematically showing the configuration of a nanobubble-containing liquid producing apparatus 64 according to the sixth embodiment. The sixth embodiment is configured in the same manner as the first embodiment, except that the liquid that is introduced into the water storage tank 1 is wastewater.

Since the wastewater is introduced into the water storage tank 1, the present embodiment can blow a large amount of nanobubbles into the wastewater in the nanobubble-containing liquid producing apparatus 64. Therefore, the constituents of the wastewater can be oxidized and degraded by the oxidativity of the nanobubbles. Further, in cases where the nanobubble-containing liquid producing apparatus 64 of the present embodiment is followed by a biological treatment facility in which microorganisms are used, the microorganisms can be activated in the facility by introducing, into the facility, a nanobubble-containing liquid prepared in the nanobubble-containing liquid producing apparatus 64, whereby the processing efficiency and processing capability of the microorganisms can be enhanced.

Seventh Embodiment

Figure 7:
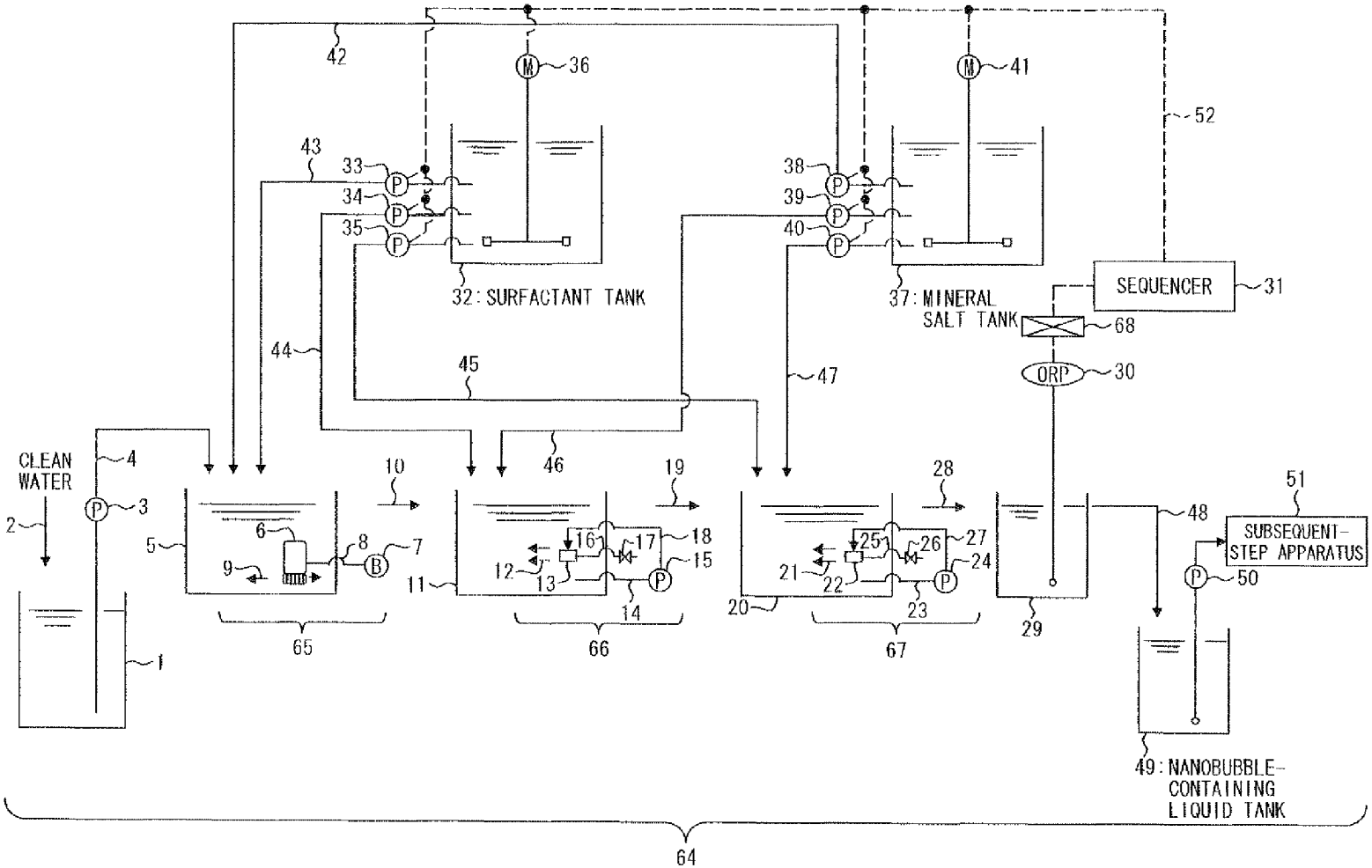
FIG. 7 is a pattern diagram showing a seventh embodiment of a nanobubble-containing liquid producing apparatus according to the present invention.

A seventh embodiment of a nanobubble-containing liquid producing apparatus according to the present invention is described below with reference to FIG. 7. FIG. 7 is a pattern diagram schematically showing the configuration of a nanobubble-containing liquid producing apparatus according to the seventh embodiment. The seventh embodiment is configured in the same manner as the first embodiment, except that the liquid that is introduced into the water storage tank 1 is clean water.

Since the clean water is introduced into the water storage tank 1, the present embodiment can blow a large amount of nanobubbles into the clean water in the nanobubble-containing liquid producing apparatus 64. Therefore, the residual persistent chemical constituents contained in minute amounts in the clean water can be oxidized and degraded by the oxidativity of the nanobubbles. Further, in cases where the nanobubble-containing liquid producing apparatus 64 of the present embodiment is followed by a biological treatment facility for improving the quality of the clean water, the processing efficiency and processing capability of microorganisms can be enhanced by activating the microorganism in the facility.

Eighth Embodiment

Figure 8:
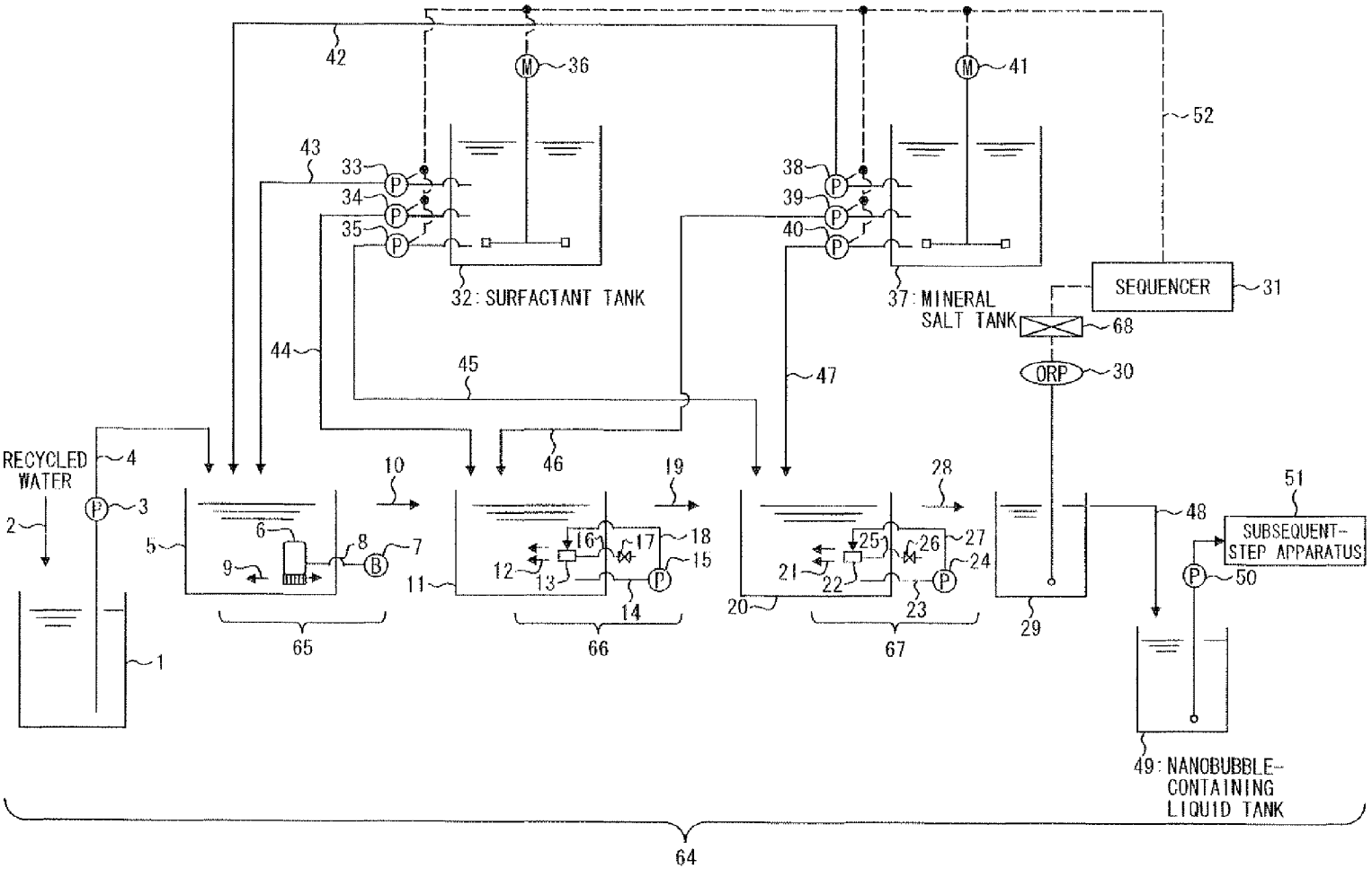
FIG. 8 is a pattern diagram showing an eighth embodiment of a nanobubble-containing liquid producing apparatus according to the present invention.

An eighth embodiment of a nanobubble-containing liquid producing apparatus according to the present invention is described below with reference to FIG. 8. FIG. 8 is a pattern diagram schematically showing the configuration of a nanobubble-containing liquid producing apparatus according to the eighth embodiment. The eighth embodiment is configured in the same manner as the first embodiment, except that the liquid that is introduced into the water storage tank 1 is recycled water.

Since the recycled water is introduced into the water storage tank 1, the present embodiment can blow a large amount of nanobubbles into the recycled water in the nanobubble-containing liquid producing apparatus 64. Therefore, the residual persistent chemical constituents or organic matter contained in minute amounts in the recycled water can be oxidized and degraded by the oxidativity of the nanobubbles. Further, in cases where the nanobubble-containing liquid producing apparatus 64 of the present embodiment is followed by a biological treatment facility for improving the quality of the recycled water, the processing efficiency and processing capability of microorganisms can be enhanced by activating the microorganism in the facility.

Ninth Embodiment

Figure 9:
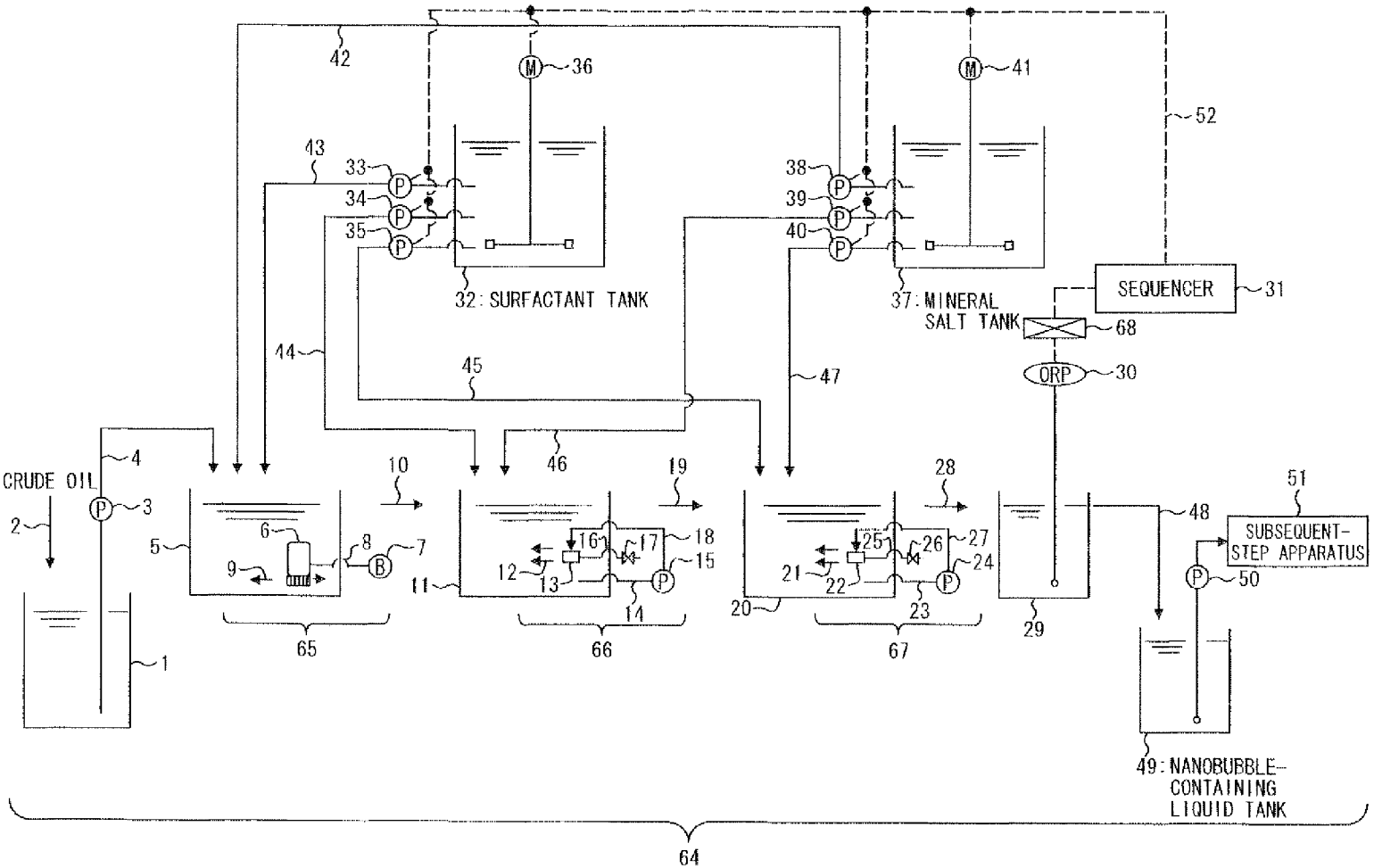
FIG. 9 is a pattern diagram showing a ninth embodiment of a nanobubble-containing liquid producing apparatus according to the present invention.

A ninth embodiment of a nanobubble-containing liquid producing apparatus according to the present invention is described below with reference to FIG. 9. FIG. 9 is a pattern diagram schematically showing the configuration of a nanobubble-containing liquid producing apparatus according to the ninth embodiment. The ninth embodiment is configured in the same manner as the first embodiment, except that the liquid that is introduced into the water storage tank 1 is crude oil.

Since the crude oil is introduced into the water storage tank 1, the present embodiment can blow a large amount of nanobubbles into the crude oil in the nanobubble-containing liquid producing apparatus 64. Therefore, the residual persistent chemical constituents or organic matter contained in minute amounts in the crude oil can be oxidized and degraded by the oxidativity of the nanobubbles. Further, in cases where the nanobubble-containing liquid producing apparatus 64 of the present embodiment is followed by a facility for refining the crude oil, the long-term presence of the nanobubbles in the crude oil can lead to an improvement in refining efficiency and refining capacity, thereby contributing to a reduction in running cost of the facility or an improvement in quality and a reduction in cost of petroleum products.

Tenth Embodiment

Figure 10:
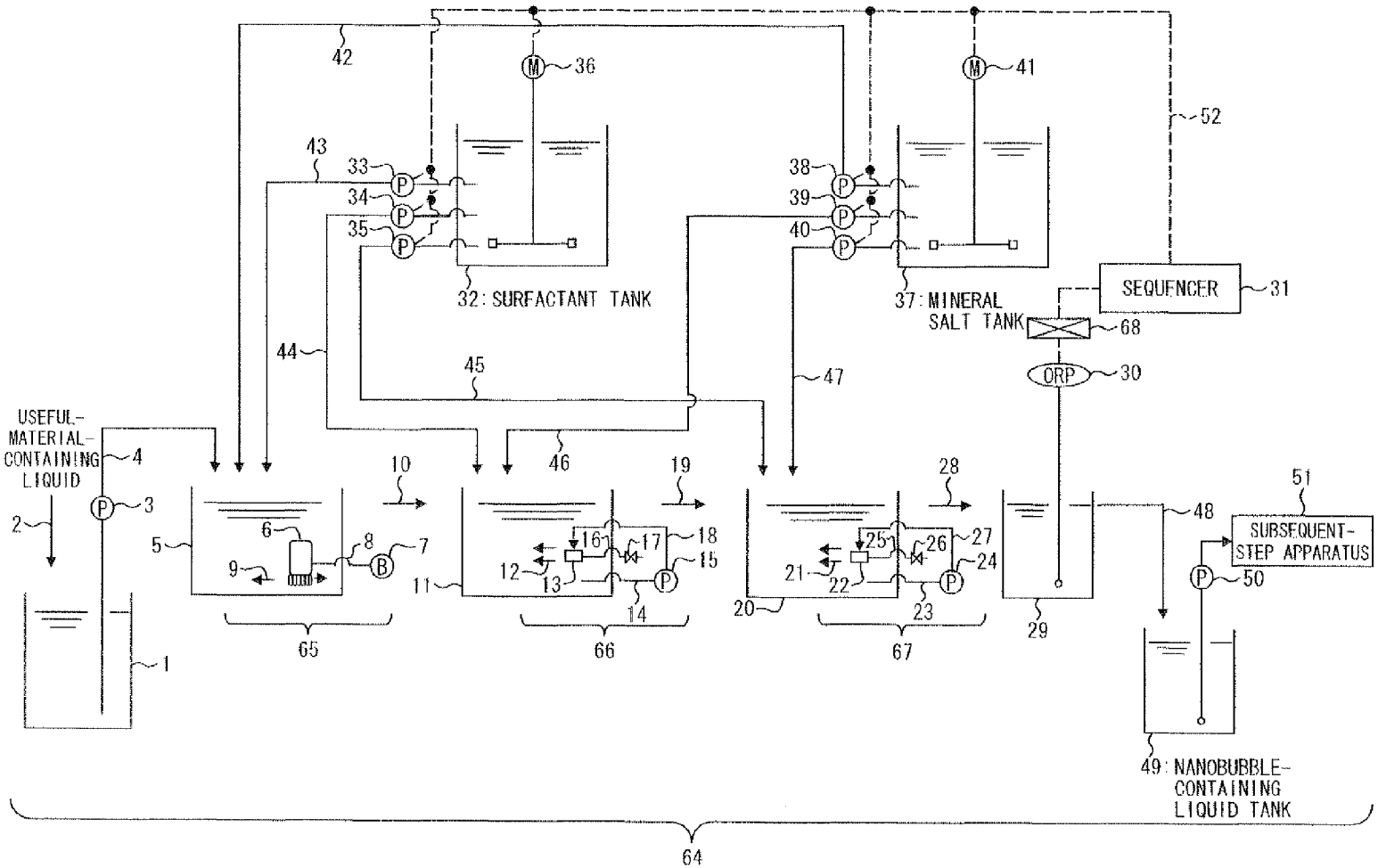
FIG. 10 is a pattern diagram showing a tenth embodiment of a nanobubble-containing liquid producing apparatus according to the present invention.

A tenth embodiment of a nanobubble-containing liquid producing apparatus according to the present invention is described below with reference to FIG. 10. FIG. 10 is a pattern diagram schematically showing the configuration of a nanobubble-containing liquid producing apparatus according to the tenth embodiment. The tenth embodiment is configured in the same manner as the first embodiment, except that the liquid that is introduced into the water storage tank 1 is a useful-material-containing liquid.

Since the useful-material-containing liquid is introduced into the water storage tank 1, the present embodiment can blow a large amount of nanobubbles into the useful-material-containing liquid in the nanobubble-containing liquid producing apparatus 64. Therefore, the amount of emergence of nanobubbles that are contained in the useful-material-containing liquid can be finely controlled, and minute amounts of impurities in the useful-material-containing liquid can be subjected to oxidation and degradation by the oxidativity of the nanobubbles.

Eleventh Embodiment

Figure 11:
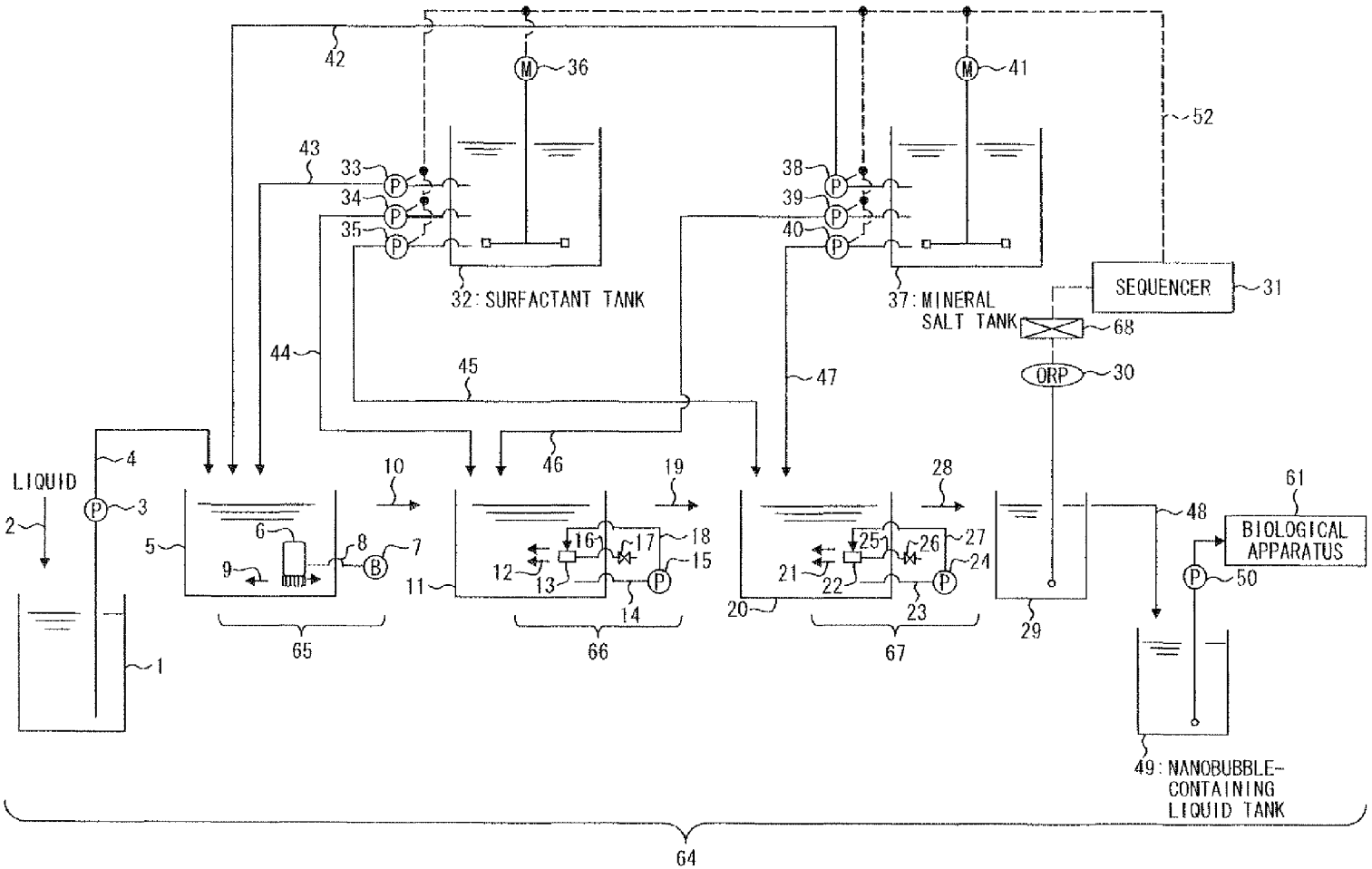
FIG. 11 is a pattern diagram showing an eleventh embodiment of a nanobubble-containing liquid producing apparatus according to the present invention.

An eleventh embodiment of a nanobubble-containing liquid producing apparatus according to the present invention is described below with reference to FIG. 11. FIG. 11 is a pattern diagram schematically showing the configuration of a nanobubble-containing liquid producing apparatus according to the eleventh embodiment. The eleventh embodiment is configured in the same manner as the first embodiment, except that the liquid stored in the nanobubble-containing liquid tank 49 is transferred into a biological apparatus 61.

The present embodiment replaces the subsequent-step apparatus 51 of the first embodiment with the biological apparatus 61. Therefore, the activity of microorganisms in the biological apparatus 61 can be enhanced by transferring, into the biological apparatus 61, a nanobubble-containing liquid containing a large amount of nanobubbles, whereby the reaction efficiency and processing capability of the apparatus can be enhanced.

Examples of the biological apparatus 61 include, but are not particularly limited to, a microbial reaction tank for use in wastewater treatment, a fermentation tank for use in fermentation of sake, beer, wine, whiskey, and the like, a bioreactor for use in manufacture of pharmaceuticals, and a bioreactor for use in biomass.

Twelfth Embodiment

Figure 12:
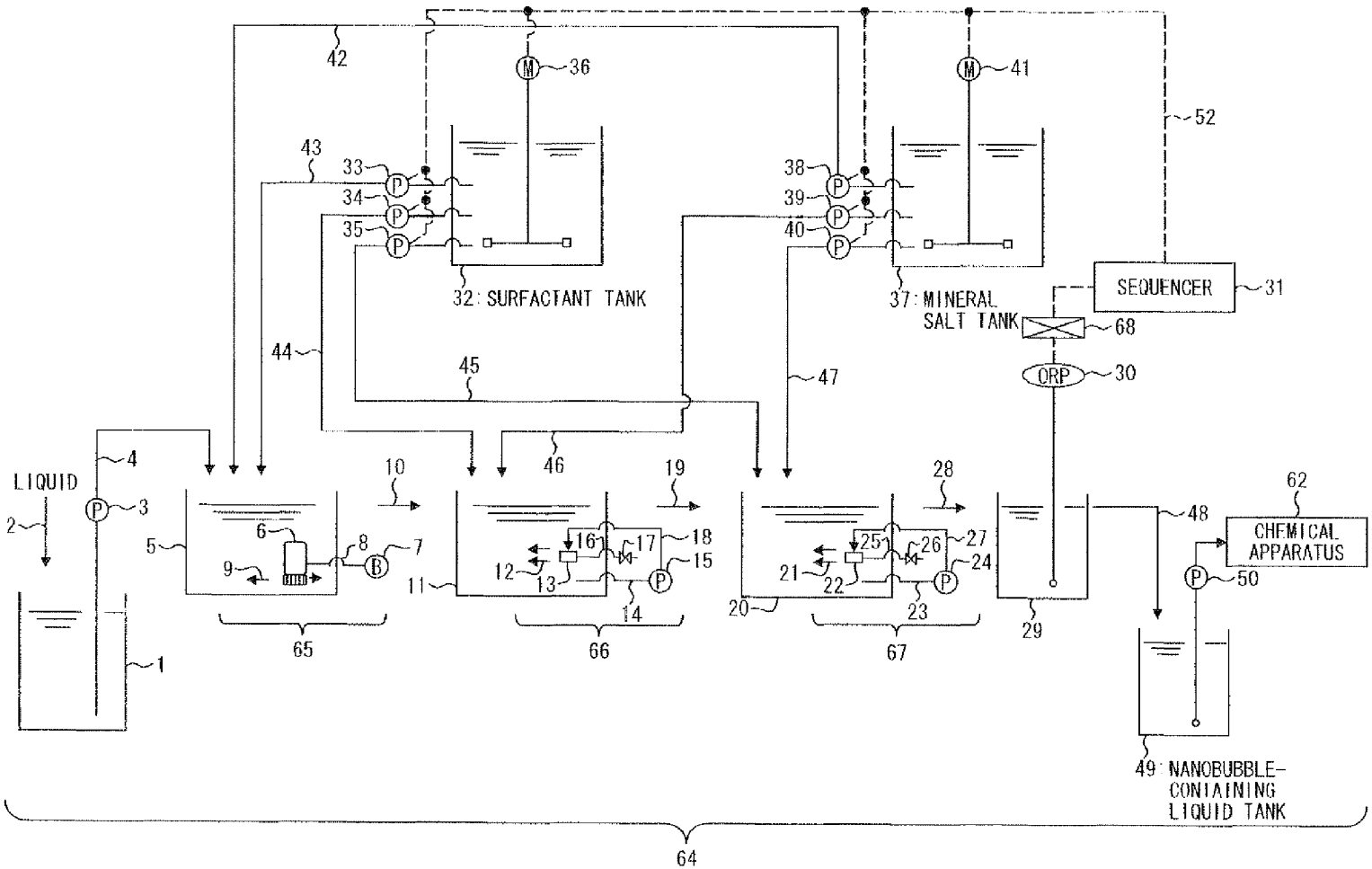
FIG. 12 is a pattern diagram showing a twelfth embodiment of a nanobubble-containing liquid producing apparatus according to the present invention.

A twelfth embodiment of a nanobubble-containing liquid producing apparatus according to the present invention is described below with reference to FIG. 12. FIG. 12 is a pattern diagram schematically showing the configuration of a nanobubble-containing liquid producing apparatus according to the twelfth embodiment. The twelfth embodiment is configured in the same manner as the first embodiment, except that the liquid stored in the nanobubble-containing liquid tank 49 is transferred into a chemical apparatus 62.

The present embodiment replaces the subsequent-step apparatus 51 of the first embodiment with the chemical apparatus 62. Therefore, the reactivity of the chemical apparatus 62 can be enhanced by transferring, into the chemical apparatus 62, a nanobubble-containing liquid containing a large amount of nanobubbles, whereby the reaction efficiency and processing capability of the apparatus can be enhanced.

The chemical apparatus 62 is not particularly limited as long as it is handled in a chemical engineering manner. Examples include a neutralization apparatus, a chemical reaction apparatus, a refinery apparatus, and a combustion apparatus.

Thirteenth Embodiment

Figure 13:
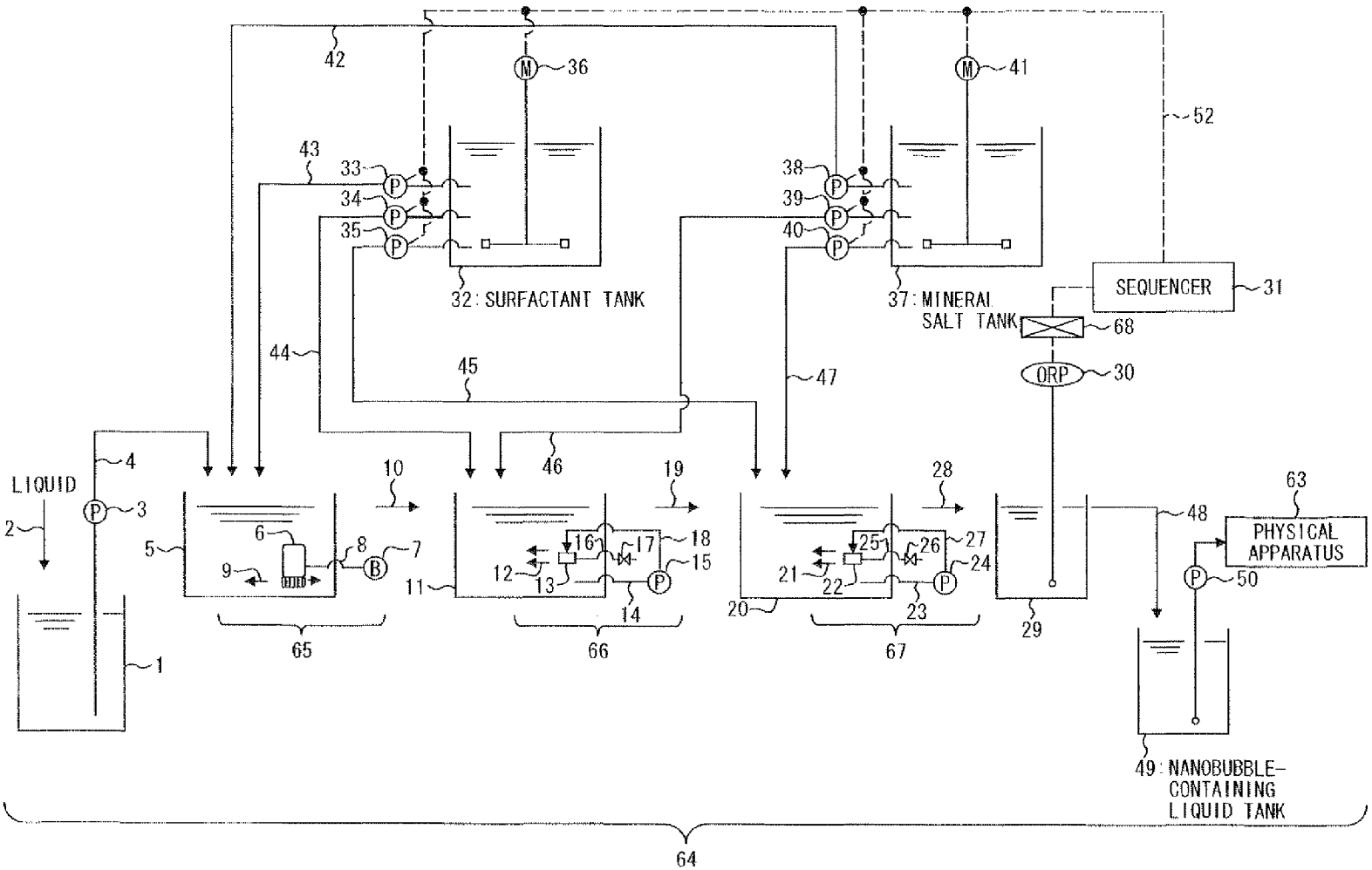
FIG. 13 is a pattern diagram showing a thirteenth embodiment of a nanobubble-containing liquid producing apparatus according to the present invention.

A thirteenth embodiment of a nanobubble-containing liquid producing apparatus according to the present invention is described below with reference to FIG. 13. FIG. 13 is a pattern diagram schematically showing the configuration of a nanobubble-containing liquid producing apparatus according to the thirteenth embodiment. The thirteenth embodiment is configured in the same manner as the first embodiment, except that the liquid stored in the nanobubble-containing liquid tank 49 is transferred into a physical apparatus 63.

The present embodiment replaces the subsequent-step apparatus 51 of the first embodiment with the physical apparatus 63. Therefore, the operationality of the physical apparatus 63 can be enhanced by transferring, into the physical apparatus 63, a nanobubble-containing liquid containing a large amount of nanobubbles, whereby the efficiency of action and processing capability of the apparatus can be enhanced.

The physical apparatus 63 is not particularly limited as long as it is handled in a chemical engineering manner. Examples include an adsorption apparatus, a dehydration apparatus, a filtration apparatus, and an evaporation apparatus.

EXAMPLES

Example 1

A nanobubble-containing liquid producing apparatus 64 for producing a nanobubble-containing liquid was manufactured with reference to FIG. 1.

The nanobubble-containing liquid producing apparatus 64 manufactured in the present example had a water storage tank 1 with a capacity of 2 $m^3$, a microbubble generation tank 5 with a capacity of 0.8 $m^3$, a micro-nanobubble generation tank 11 with a capacity of 0.8 $m^3$, a nanobubble generation tank 20 with a capacity of 0.8 $m^3$, a measuring tank 29 with a capacity of 0.5 $m^3$, a nanobubble-containing liquid tank 49 with a capacity of 2 $m^3$ a surfactant tank 32 with a capacity of 0.4 $m^3$, and a mineral salt tank 37 with a capacity of 0.4 $m^3$.

The nanobubble-containing liquid producing apparatus 64 used a Micro-Bubbler MD-400 manufactured by Nomura Electronics Co., Ltd. as a microbubble generating device 65, and products Model M2 of Nanoplanet Research Institute Corporation as a micro-nanobubble generating device 66 and a nanobubble generating device 67. Further, the nanobubble-containing liquid producing apparatus 64 used products of DKK-TOA Corporation as an oxidation-reduction potential detecting section 30 and an oxidation-reduction potential regulator 68 that were installed in the measuring tank 29.

Further, into the surfactant tank 32, a cationic surfactant was poured as a surfactant and stirred by running the first stirring machine 36. Further, into the mineral salt tank 37, sodium chloride was poured as a mineral salt and stirred by running the second stirring machine 41.

Water was poured as a liquid into the water storage tank 1 of the nanobubble-containing liquid producing apparatus 64 thus configured, and the apparatus was operated. Water obtained in the nanobubble-containing liquid tank 49 after three hours of operation of the apparatus was analyzed by a Coulter counter (manufactured by Beckmann Coulter, Inc.), whereby 266,000 pieces/ml of nanobubbles were observed, most of which measured approximately 120 nm in size.

Example 2

Example 2 was performed under each, of the following three conditions: (A) neither the surfactant nor the mineral salt was added; (B) only the surfactant was added; and (C) only the mineral salt was added. Except these conditions, nanobubbles were prepared in the same manner as in Example 1. Further, the present example used a mild detergent as the surfactant, and sodium chloride as the mineral salt. The results are shown in Table 1.

TABLE 1

| | | Name of Additive | | |
|---|---|---|---|---|
| | Unit | No Additive | Mild Detergent | Mineral Salt |
| Amount Added | ppm | 0 | 1,000 | 1,000 |
| Total Number of Nanobubbles | pieces/ml | 130-860 | 280,000-410,000 | 160,000-320,000 |

As shown in this table, in the case (A) where neither the surfactant nor the mineral salt was added, the total number of nanobubbles generated was 130 to 860 pieces/ml; in the case (B) where only the surfactant was added, the total number of nanobubbles generated was 280,000 to 410,000 pieces/ml; and in the case where (C) only the mineral salt was added, the total number of nanobubbles generated was 160,000 to 320,000 pieces/ml.

As described above, a nanobubble-containing liquid producing apparatus according to the present embodiment is such that three tanks having uncomplicatedly structured microbubble generating devices (i.e., a microbubble generating device 65, a micro-nanobubble generating device 66, and a nanobubble generating device 67) installed therein are connected in series. In other words, a nanobubble-containing liquid producing apparatus according to the present invention is such that: three or more water tanks each having a microbubble generator installed therein are disposed in series; and a nanobubble-containing liquid is produced in the last tank by running the respective microbubble generators of the water tanks while introducing a liquid sequentially from the first to third tanks. This causes nanobubbles to be generated in the third tank, which is the last tank.

Further, the amount of bubbles that exist in each tank can be increased by adding the surfactant or the inorganic salt to any one or all of the first to third tanks, whereby the amount of nanobubbles that are generated can be remarkably increased.

Therefore, the nanobubble-containing liquid producing apparatus according to the present invention makes it possible for an apparatus for producing a nanobubble-containing liquid to be manufactured at low cost and in a short period of time.

Thus, the nanobubble-containing liquid producing apparatus according to the present invention makes it possible for an apparatus for producing a nanobubble-containing liquid to be manufactured at low cost and in a short period of time.

A nanobubble-containing liquid producing apparatus according to the present invention can be applied to service water treatment, wastewater treatment, and bathtub treatment, and can be further used in the field of health and the field of medicine.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

| Reference Signs List | |
|---|---|
| 1 | Water storage tank |
| 2 | Inflow pipe |
| 3 | First transfer pump (first transfer means) |
| 4 | Liquid pipe |
| 5 | Microbubble generation tank (first tank) |
| 6 | Microbubble generator |
| 7 | Small-sized blower (first gas supply means) |
| 8 | Gas pipe |
| 9 | Bubble liquid current |
| 10 | Overflow pipe |
| 11 | Micro-nanobubble generation tank (second tank) |
| 12 | Bubble liquid current |
| 13 | Micro-nanobubble generator |
| 14 | Suction pipe |
| 15 | Circulating pump |
| 16 | Gas pipe |
| 17 | Gas needle valve (second gas supply means) |
| 18 | Liquid pipe |
| 19 | Overflow pipe |
| 20 | Nanobubble generation tank (third tank) |
| 21 | Bubble liquid current |
| 22 | Nanobubble generator |
| 23 | Suction pipe |
| 24 | Circulating pump |
| 25 | Gas pipe |
| 26 | Gas needle valve (third gas supply means) |
| 27 | Liquid pipe |
| 28 | Overflow pipe |
| 29 | Measuring tank (fourth tank) |
| 30 | Oxidization-reduction potential detecting section |
| 31 | Sequencer (control means) |
| 32 | Surfactant tank |
| 33 | First metering pump (surfactant metering and injecting means) |
| 34 | Second metering pump (surfactant metering and injecting means) |
| 35 | Third metering pump (surfactant metering and injecting means) |
| 36 | First stirring machine |
| 37 | Mineral salt tank |
| 38 | Fourth metering pump (mineral salt metering and injecting means) |
| 39 | Fifth metering pump (mineral salt metering and injecting means) |
| 40 | Sixth metering pump (mineral salt metering and injecting means) |
| 41 | Second stirring machine |

-continued

| Reference Signs List | |
|---|---|
| 42 | Chemical pipe (mineral salt supply means) |
| 43 | Chemical pipe (surfactant supply means) |
| 44 | Chemical pipe (surfactant supply means) |
| 45 | Chemical pipe (surfactant supply means) |
| 46 | Chemical pipe (mineral salt supply means) |
| 47 | Chemical pipe (mineral salt supply means) |
| 48 | Overflow pipe |
| 49 | Nanobubble-containing liquid tank |
| 50 | Second transfer pump (second transfer means) |
| 51 | Subsequent-step apparatus |
| 52 | Signal line |
| 53 | Zeta potential detecting section |
| 54 | Bubble liquid, current |
| 55 | Microbubble generator |
| 56 | Suction pipe |
| 57 | Circulating pump |
| 58 | Gas pipe |
| 59 | Gas needle valve |
| 60 | Liquid pipe |
| 61 | Biological apparatus |
| 62 | Chemical apparatus |
| 63 | Physical apparatus |
| 64 | Nanobubble-containing liquid producing apparatus |
| 65 | Microbubble generating device (first microbubble-containing liquid preparing means) |
| 65' | Microbubble generating device (first microbubble-containing liquid preparing means) |
| 66 | Micro-nanobubble generating device (second micro-nanobubble-containing liquid preparing means) |
| 67 | Nanobubble generating device (third nanobubble-containing liquid preparing means) |
| 68 | Oxidization-reduction potential regulator |
| 69 | Zeta potential regulator |

The invention claimed is:

1. A nanobubble-containing liquid producing apparatus comprising:

first microbubble-containing liquid preparing means that prepares a first fine-bubble-containing liquid with use of a liquid introduced into a first tank;

second micro-nanobubble-containing liquid preparing means that prepares a second fine-bubble-containing liquid with use of the first fine-bubble-containing liquid introduced into a second tank; and third nanobubble-containing liquid preparing means that prepares a third fine-bubble-containing liquid with use of the second fine-bubble-containing liquid introduced into a third tank.

2. The nanobubble-containing liquid producing apparatus as set forth in claim 1, wherein:

the first microbubble-containing liquid preparing means further includes a first shearing section that prepares the first fine-bubble-containing liquid by mixing and shearing the liquid and first supplied gas;

the second micro-nanobubble-containing liquid preparing means further includes a second shearing section that prepares the second fine-bubble-containing liquid by further shearing the first fine-bubble-containing liquid; and the third nanobubble-containing liquid preparing means further includes a third shearing section that prepares the third fine-bubble-containing liquid by further shearing the second fine-bubble-containing liquid.

3. The nanobubble-containing liquid producing apparatus as set forth in claim 2, wherein the first microbubble-containing liquid preparing means further includes first gas supply means that supplies the first supplied gas to the first shearing section.

4. The nanobubble-containing liquid producing apparatus as set forth in claim 3, wherein:

the second micro-nanobubble-containing liquid preparing means further includes second gas supply means through which second supplied gas is supplied to the second shearing section, and the second shearing section prepares the second fine-bubble-containing liquid by mixing and shearing the second supplied gas and the first fine-bubble-containing liquid; and the third nanobubble-containing liquid preparing means further includes third gas supply means through which third supplied gas is supplied to the third shearing section, and the third shearing section prepares the third fine-bubble-containing liquid by mixing and shearing the third supplied gas and the second fine-bubble-containing liquid.

5. The nanobubble-containing liquid producing apparatus as set forth in claim 4, wherein the preparation of the first fine-bubble-containing liquid by the first shearing section, the preparation of the second fine-bubble-containing liquid by the first shearing section, and the preparation of the third fine-bubble-containing liquid by the third shearing section are each carried out by a cavitation system, a pressure-solution system, a turbulent-shear system, a high-speed rotation stirring system, or a swirling-flow system.

6. The nanobubble-containing liquid producing apparatus as set forth in claim 1, further comprising:

a water storage tank into which the liquid is introduced; and first transfer means that transfers the liquid stored in the water storage tank into the first tank.

7. The nanobubble-containing liquid producing apparatus as set forth in claim 1, wherein the liquid is wastewater, clean water, recycled water, crude oil, fuel oil, a useful-material-containing liquid, groundwater, air-conditioning water, bathtub water, or scrubber water.

8. The nanobubble-containing liquid producing apparatus as set forth in claim 1, further comprising:

a fourth tank into which the third fine-bubble-containing liquid is introduced; and nanobubble content measuring means that measures a nanobubble content of the third fine-bubble-containing liquid stored in the fourth tank.

9. The nanobubble-containing liquid producing apparatus as set forth in claim 8, wherein the nanobubble content measuring means further includes oxidization-reduction potential detecting means and measures the nanobubble content in accordance with an oxidization-reduction potential of the third fine-bubble-containing liquid as detected by the oxidization-reduction potential detecting means.

10. The nanobubble-containing liquid producing apparatus as set forth in claim 8, wherein the nanobubble content measuring means includes a zeta potential detecting means and measures the nanobubble content in accordance with a zeta potential of the third fine-bubble-containing liquid as detected by the zeta potential detecting means.

11. The nanobubble-containing liquid producing apparatus as set forth in claim 1, further comprising:

a surfactant tank having a surfactant stored therein; and surfactant supply means through which the surfactant stored in the surfactant tank is supplied to each of the first to third tanks.

12. The nanobubble-containing liquid producing apparatus as set forth in claim 1, further comprising:

a mineral salt tank having an inorganic salt stored therein; and inorganic salt supply means through which the inorganic salt stored in the mineral salt tank is supplied to each of the first to third tanks.

13. The nanobubble-containing liquid producing apparatus as set forth in claim 11, further comprising surfactant metering pumps that regulate amounts of the surfactant that is supplied from the surfactant tank to the first to third tanks, respectively.

14. The nanobubble-containing liquid producing apparatus as set forth in claim 13, further comprising control means that controls the surfactant metering pumps in accordance with the nanobubble content measured by the nanobubble content measuring means, so that the amounts of the surfactant that is supplied are regulated.

15. The nanobubble-containing liquid producing apparatus as set forth in claim 12, further comprising inorganic salt metering pumps that regulate amounts of the inorganic salt that is supplied from the mineral salt tank to the first to third tanks, respectively.

16. The nanobubble-containing liquid producing apparatus as set forth in claim, 15, further comprising control means that controls the inorganic salt metering pumps in accordance with the nanobubble content measured by the nanobubble content measuring means, so that the amounts of the inorganic salt that is supplied are regulated.

17. The nanobubble-containing liquid producing apparatus as set forth in claim 1, further comprising second transfer means that transfers the third fine-bubble-containing liquid stored in the third or fourth tank into a biological apparatus, a chemical apparatus, a physical apparatus, or a bathtub apparatus.

18. A nanobubble-containing liquid producing method comprising:

a first microbubble-containing liquid preparing step of preparing a first fine-bubble-containing liquid with use of a liquid introduced into a first tank;

a second micro-nanobubble-containing liquid preparing step of preparing a second fine-bubble-containing liquid with use of the first fine-bubble-containing liquid introduced into a second tank; and a third nanobubble-containing liquid preparing step of preparing a third fine-bubble-containing liquid with use of the second fine-bubble-containing liquid introduced into a third tank.

* * * * *